US010421182B2

(12) United States Patent
Schumacher

(10) Patent No.: US 10,421,182 B2
(45) Date of Patent: Sep. 24, 2019

(54) WORK SURFACE

(71) Applicant: REDesign Group, LLC, Boulder, CO (US)

(72) Inventor: Robert A. Schumacher, Boulder, CO (US)

(73) Assignee: REDESIGN GROUP, LLC, Boulder, CO (US)

( * ) Notice: Subject to any disclaimer, the term of this patent is extended or adjusted under 35 U.S.C. 154(b) by 0 days.

(21) Appl. No.: 15/729,055

(22) Filed: Oct. 10, 2017

(65) Prior Publication Data

US 2018/0029216 A1 Feb. 1, 2018

Related U.S. Application Data

(63) Continuation-in-part of application No. 15/051,307, filed on Feb. 23, 2016, now Pat. No. 9,821,450.

(60) Provisional application No. 62/120,169, filed on Feb. 24, 2015.

(51) Int. Cl.
*B25H 1/04* (2006.01)
*B25H 1/08* (2006.01)

(52) U.S. Cl.
CPC ..... *B25H 1/08* (2013.01); *B25H 1/04* (2013.01)

(58) Field of Classification Search
CPC ..... B25H 1/08; B25H 1/04
See application file for complete search history.

(56) References Cited

U.S. PATENT DOCUMENTS 4,333,638 A 6/1982 Gillotti
7,055,563 B2 * 6/2006 Logan ..... B23D 47/025 108/127
9,821,450 B2 11/2017 Schumacher

OTHER PUBLICATIONS

Official Action for U.S. Appl. No. 15/051,307, dated Jan. 19, 2017 11 pages.
Notice of Allowance for U.S. Appl. No. 15/051,307, dated Jul. 11, 2017 14 pages.
Corrected Notice of Allowance for U.S. Appl. No. 15/051,307, dated Aug. 23, 2017 11 pages.

* cited by examiner

*Primary Examiner* — David P Bryant
*Assistant Examiner* — Nirvana Deonauth
(74) *Attorney, Agent, or Firm* — Sheridan Ross P.C.

(57) ABSTRACT

A work surface is provided. More particularly, a work surface that is portable, and that when deployed provides a relatively stable platform is disclosed. The work surface includes at least two horizontal tracks running parallel to a top surface, and one or more vertical tracks running parallel to the legs of the work surface. The horizontal tracks are configured to receive one or more clamps or various accessories, such as crosscut accessories. The crosscut accessories can include provisions for accurately securing a saw guide and a work piece to the work surface. In addition, an accessory stand can be connected to the work surface to allow various tools to be operatively connected to the work surface.

2 Claims, 25 Drawing Sheets

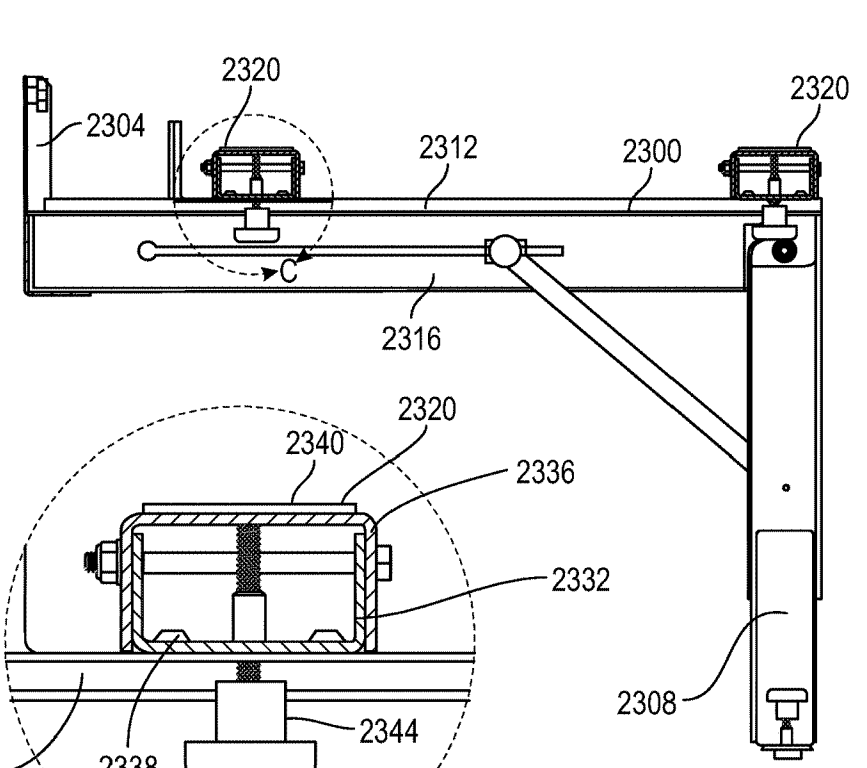
FIG. 24B
FIG. 24C
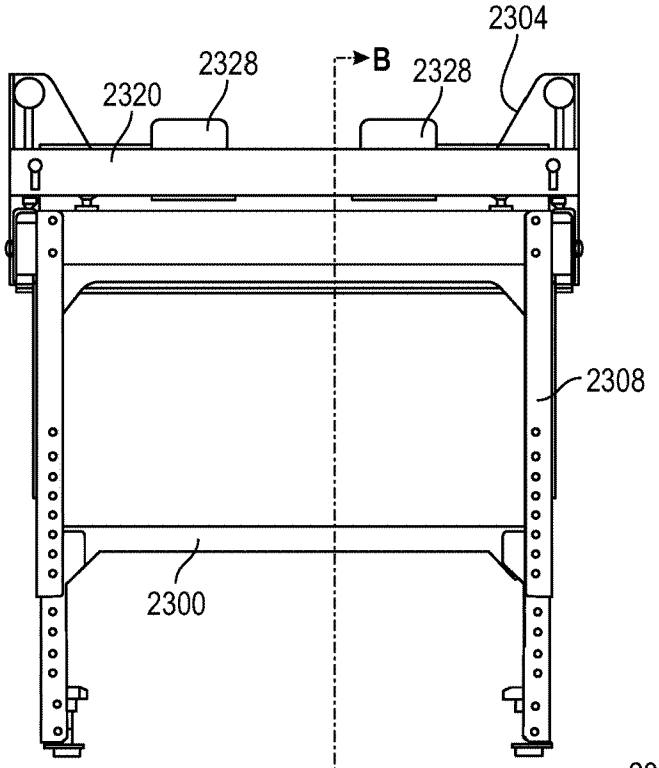
FIG. 24A

WORK SURFACE

CROSS-REFERENCE TO RELATED APPLICATIONS

This application is a continuation-in-part of U.S. patent application Ser. No. 15/051,307, filed Feb. 23, 2016, which claims the benefit of U.S. Provisional Patent Application Ser. No. 62/120,169, filed Feb. 24, 2015, the entire disclosures of which are hereby incorporated herein by reference.

FIELD

A work surface with enhanced material holding and clamping features, and related accessories, is provided.

BACKGROUND

The traveling carpenter, cabinetmaker/installer, and general handyperson has always needed easily transportable work surfaces for jobsite use. Traditional devices invariably involve multiple compromises between mobility, complexity, weight, versatility, and ergonomics. The skilled craftsperson requires a strong, flat, rigid, stable platform that can be set up easily, quickly, and accurately in various environments, and which allows comfortable access to workpieces of many sizes. Typical solutions to these needs involve saw horses with plywood or old doors placed on top to make a platform. These are unstable and irregular and are poor substitutes for the sort of stout work bench that would traditionally be used in a workshop, but which is too heavy and cumbersome to transport.

Numerous attempts have been made during the last 100 years to devise a good, mobile substitute for the shop bench. To varying extents, all are defined by compromise, whether in pursuit of light weight, convenient size based on transportability, and/or the complexity/variety of integrated features and accessories. Common complaints are that, for example, what is available is too small to be of practical use, too low, too flexible, or too constrained by an ill-conceived method of work to allow the craftsperson to fully utilize his/her creativity in an efficient way.

In addition, it is useful to integrate various accessories with a work surface. For example, guides and mounts to facilitate making cuts, such as crosscuts, using power saws have been developed. However, existing assemblies have been unable to provide the levels of precision required for high quality wood working. As another example, it can be desirable to use a work surface in combination with a portable table saw. However, universal supports capable of providing a secure and accurately aligned connection between such table saws and work surfaces have not been available.

SUMMARY

Embodiments of the present disclosure provide a system including a work surface or workbench assembly for supporting workpieces. More particularly, a portable work surface or workbench that is stable, and that can be configured to hold workpieces that are large relative to the work surface is provided.

In accordance with the least to some embodiments of the present disclosure, the work surface includes a planar top surface, and a plurality of legs that are folded against a back of the planar top surface when the workbench is in a folded configuration, and that extend such that they are substantially orthogonal to the planar top surface when the work surface is in a deployed configuration.

In accordance with still other embodiments of the present disclosure, tracks or track members that are adapted to receive clamps or support blocks are provided. One or more of the tracks can be arranged such that they extend in a vertical direction, for example along the legs of the workbench. In addition, one or more of the tracks can be arranged such that they extend in a horizontal direction, for example along an edge of the top surface of the workbench. In accordance with at least some embodiments of the present disclosure, a support block can be placed at a desired location along a vertical track, to support an edge of a work piece, while a clamp can be placed at a desired location along a horizontal track, to clamp the work piece against the side of the top surface of the workbench. In accordance with still other embodiments of the present disclosure, multiple support blocks can be used, to support a work piece at multiple locations along an edge of the work piece. Moreover, multiple clamps can be used to hold the work piece in position, while that work piece is also supported by one or more support blocks.

In accordance with still other embodiments of the present disclosure, a work surface and integrated accessories are provided. For example, crosscut accessories that include one or more fences, saw guide supports, and material supports can be provided. A fence can be connected to the work surface using one of the provided tracks, and can provide a material support surface in a plane that is parallel to the connected track, and that is perpendicular to the support surface of the work surface. A fence can additionally have material support elements integrated therein or connected thereto, such as a flip stop and a work holding clamp. Similarly, saw guide supports can be connected to the work surface using provided tracks. The saw guide supports can be configured to accurately align and securely hold a saw guide, and can incorporate a material support element.

Another example of an accessory in accordance with embodiments of the present disclosure is a saw stand. The saw stand can be connected to an end of the work surface, and provides support elements or rests for a portable table saw. The support elements include adjustments within a plane that is substantially parallel to the plane of the support surface, to accommodate saws of different dimensions. The saw stand can also be adjusted in a vertical direction. In addition, the support elements provide for fine adjustments in a direction substantially perpendicular to the plane of the support surface.

Additional features and advantages of embodiments of the present disclosure will become more readily apparent from the following description, particularly when taken together with the accompanying drawings.

BRIEF DESCRIPTION OF THE DRAWINGS

FIG. 24A is an end elevation of a saw stand in accordance with embodiments of the present disclosure;

FIG. 24B is a side elevation in cross-section of a saw stand in accordance with embodiments of the present disclosure; and FIG. 24C is a detail of a saw rest in accordance with embodiments of the present disclosure.

DETAILED DESCRIPTION

Figure 1:
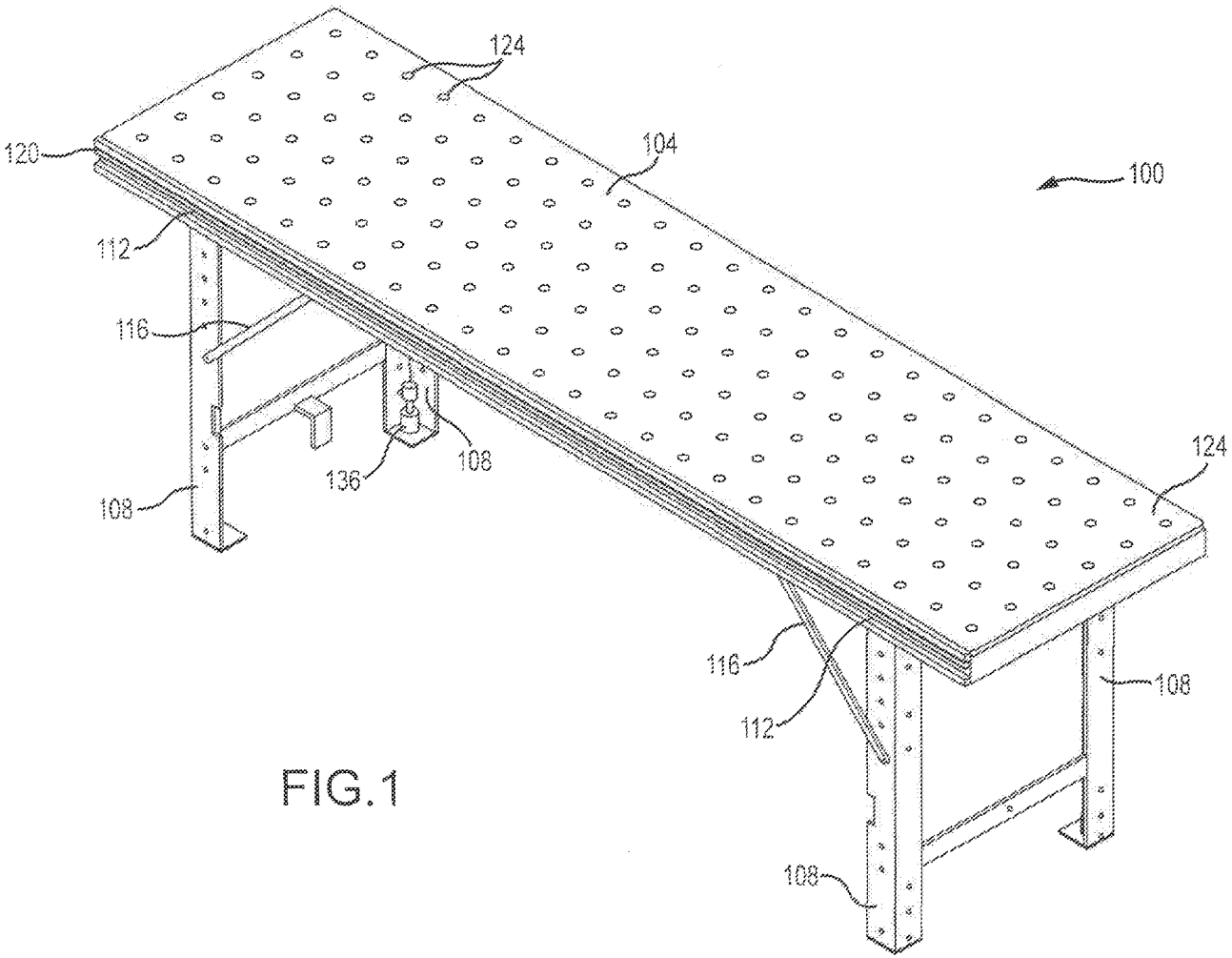
FIG. 1 is a top perspective view of a workbench in accordance with embodiments of the present disclosure, in a deployed configuration.

With reference now to FIG. 1, embodiments of the present disclosure provide a work surface or workbench 100. In accordance with at least some embodiments, the work surface 100 includes a portable work surface that can be configured in a relatively compact state for portability, and a stable, extended state for use. The work surface 100 generally includes a top surface 104, and a plurality of legs 108 that are connected to the top surface 104 by hinges or pivots 112. When configured for portability, the legs 108 are folded or stowed, such that the longitudinal axis of each leg is generally parallel to a plane corresponding to a top of the top surface 104. In a deployed state, the legs 108 are generally orthogonal to the plane of the top surface 104. The legs 108 can be held in the deployed position by braces 116. The braces 116 can be connected to the top surface 104 via a track that allows the braces to be moved with the legs, such that the braces 116 are generally parallel to the top surface 104 and the legs 108 when the legs are stowed, and such that the braces are at an angle (e.g. a 45° angle) to the top surface 104 and the legs 108 when the legs 108 are extended. In the extended position, the location of the braces 116 within the horizontal track can be fixed, for example by a threaded fastener.

The work surface or table 100 is generally brought to a worksite in a folded configuration, with the legs 108 locked against a bottom of the top surface 104 by brackets and associated threaded fasteners. In order to deploy the work surface 100 for use, the threaded fasteners holding the brackets are removed, and the legs 108 are extended such that the longitudinal axes of the legs 108 are generally orthogonal to a plane of the top surface 104. As the legs 108 are pivoted on the hinges 112, the ends of the braces 116 attached to the top surface 104 at the rails slide along those rails. Once the legs 108 are fully extended, which can correspond to the braces 116 reaching an end of the horizontal rails, fasteners attaching the ends of the braces 116 to the top surface 104 can be tightened, to fix the position of the legs 108 relative to the top surface 104. After the legs 108 have been deployed, leg leveler assemblies 136 can be adjusted by turning the support leg in the threaded insert, to prevent rocking of the work surface 100 while it is in use.

A horizontal clamp track 120 can be provided along one or more edges of the top surface 104. More particularly, and as discussed in greater detail elsewhere herein, the horizontal clamp track 120 is oriented such that workpieces can be clamped against a side of the top surface 104. Accordingly, for example where a workpiece is substantially planar, the workpiece is at an angle of 90° with respect to the plane of the top surface 104 when the workpiece is held by a clamp placed in the horizontal clamp track 120. In addition, the planar top surface server 104 can feature a plurality of holes 124 that are configured to receive clamps, dogs, and/or other accessories. The holes 124 can be arranged in a two-dimensional grid or array pattern across the top surface 104.

A leg leveler assembly 136 can be provided at a bottom end of each leg 108. Each leg leveler assembly 136 can include a threaded insert that is fixed to the associated leg 108. As an example, but without limitation, the threaded insert can include a captured nut that is friction fit and/or adhered to a support block that is in turn fixed to the leg 108. The amount by which a support surface of the leg leveler assembly 136 extends beyond the bottom of the leg 108 can be adjusted by, for example, placing a wrench or other tool on the head portion, and turning the threaded insert.

Figure 2:
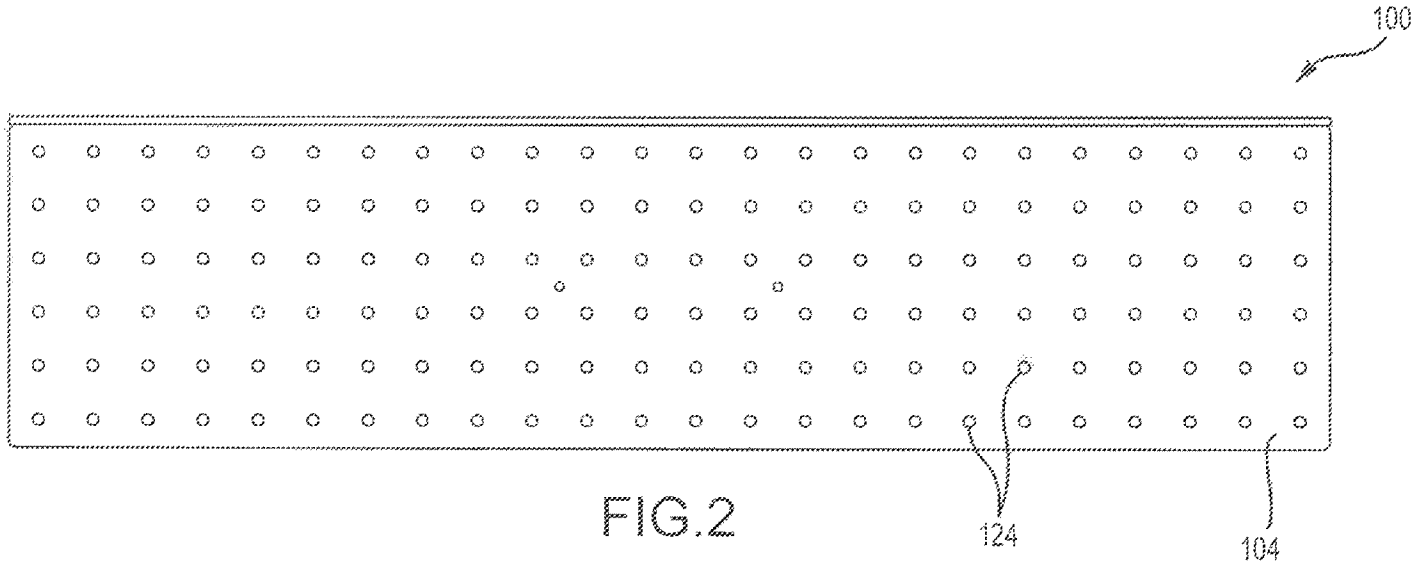
FIG. 2 is a top plan view of the workbench of FIG. 1.

FIG. 2 depicts the work surface 100, and in particular the top surface 104, in plan view. As shown, the holes or apertures 124 can be configured to form a grid of holes 124 that are regularly spaced across the top surface 104. As can be appreciated by one of skill in the art after consideration of the present disclosure, the holes 124 can receive various tools, clamps, and locating devices or accessories.

Figure 3:
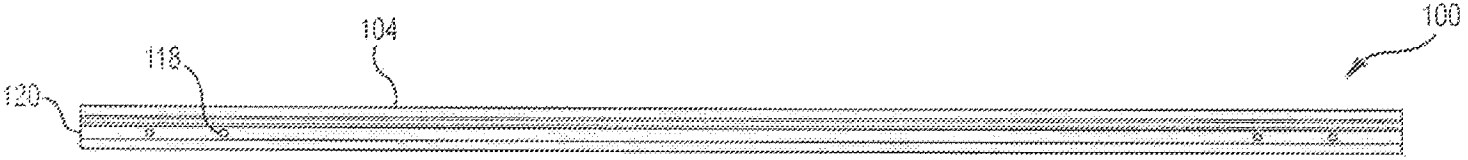
FIG. 3 is a side elevation of the workbench of FIG. 1, in a folded configuration.
Figure 4:
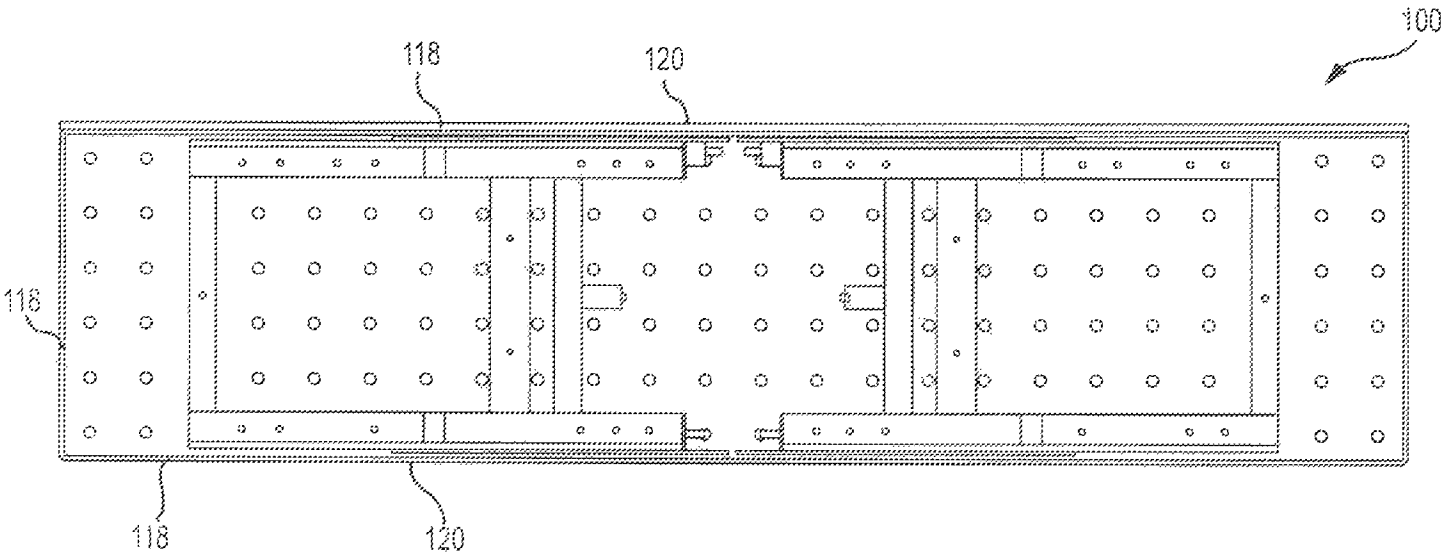
FIG. 4 is a bottom plan view of the workbench of FIG. 1, in a folded configuration.

FIG. 3 depicts the work surface 100 in elevation, and FIG. 4 depicts the work surface 100 in a bottom plan view, with the legs 108 folded parallel to the top surface 104, in a portable configuration. In this configuration, the legs 108 can be nested within sidewalls 118, for example formed by or associated with horizontal clamp tracks 120 located around a perimeter of the top surface 104.

Figure 5:
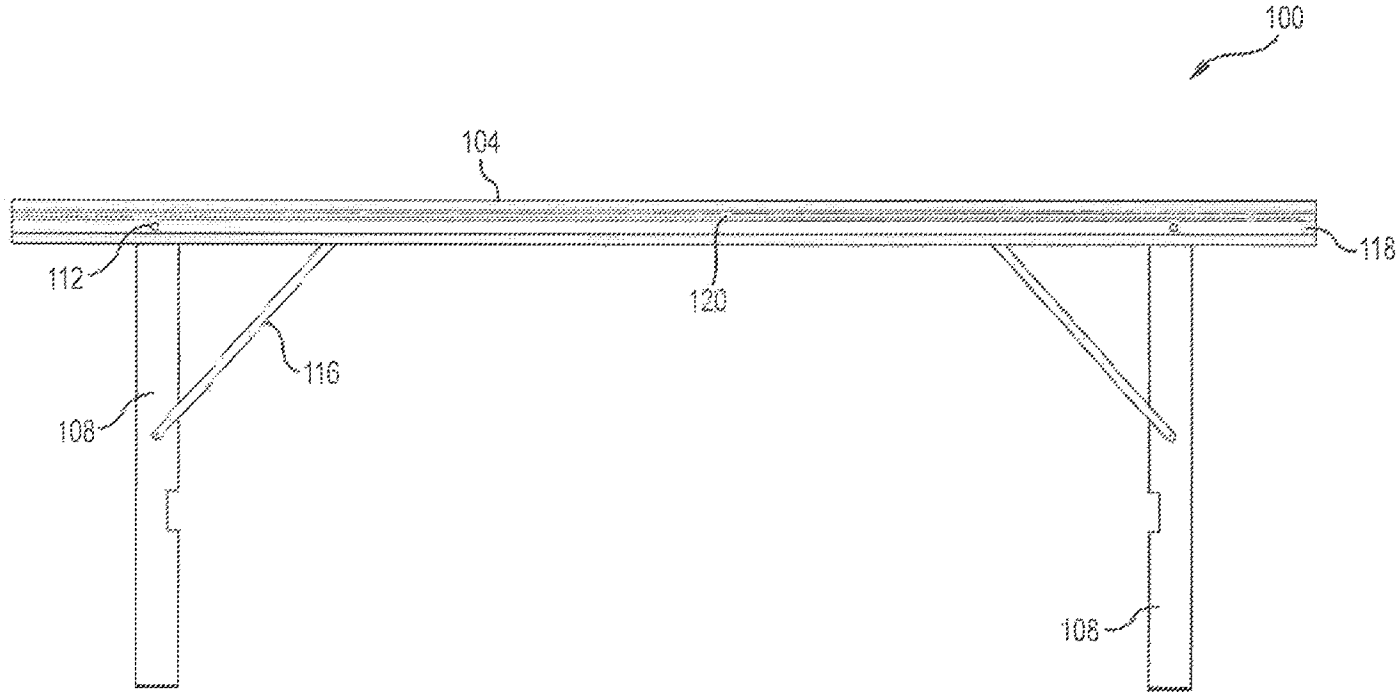
FIG. 5 is a side elevation of the workbench of FIG. 1, in a deployed configuration.
Figure 6:
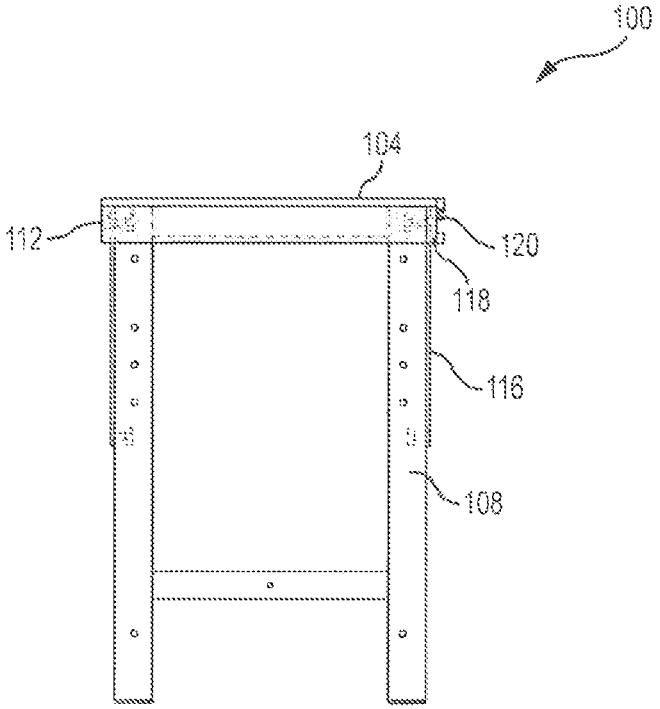
FIG. 6 is an end elevation of the workbench of FIG. 1, in a deployed configuration.

FIG. 5 depicts the work surface 108 side elevation, and FIG. 6 depicts the work surface 100 in an end elevation, in a deployed or standing configuration.

Figure 7:
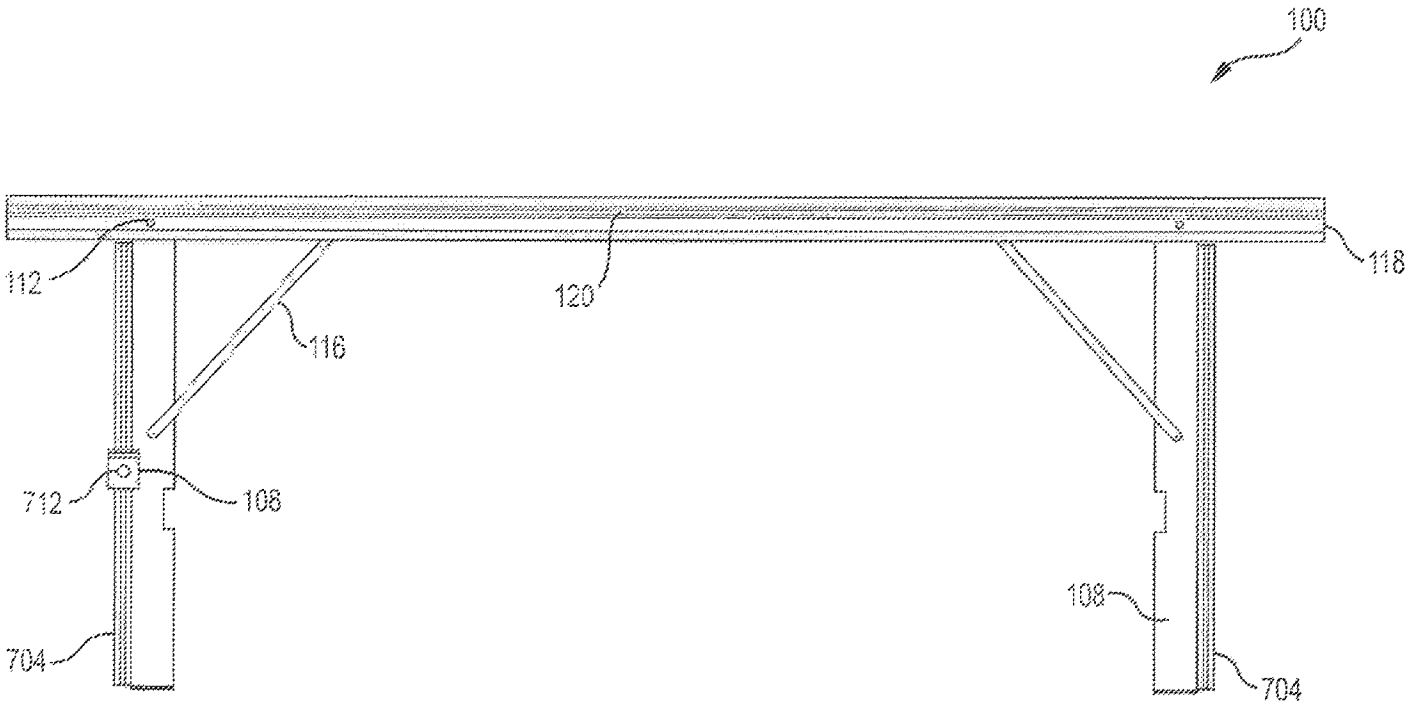
FIG. 7 is a side elevation of the workbench of FIG. 1, in a deployed configuration, and with vertical tracks installed.
Figure 8:
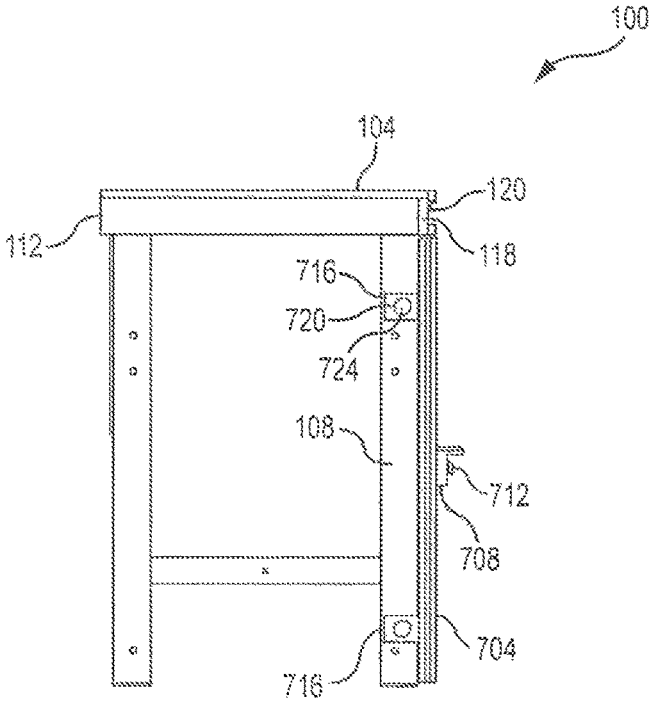
FIG. 8 is an end elevation of the workbench of FIG. 1, in a deployed configuration, and with vertical tracks installed.

FIG. 7 depicts the work surface 100 in a side elevation, and FIG. 8 depicts the work surface 100 in an end elevation, in a deployed or standing configuration, and with vertical tracks 704 installed. More particularly, the vertical tracks 704 are shown attached to first 108*a* and second 108*b* legs of the work surface 100. A support block 708 can be received by the vertical track 704. The position of the support block 708 along the vertical track 704 can be adjusted. More particularly, a fastening knob 712 associated with a threaded fastener can be loosened to move the support block 708 along the vertical track 704, and can be tightened to secure the support block 708 at a desired location.

With particular reference now to FIG. 8, the vertical tracks 704 can include mounting flanges or members 716. The vertical tracks 704 can be attached to an associated leg 108 by threaded fasteners 720 that pass through the mounting-flange 716 and that are associated with a knob 724. As an example the position of the vertical tracks 704 on the respective legs 108 can be determined by the threaded fasteners 720 and captured nuts on the legs 108 that receive the threaded fasteners 720, in combination with locating surfaces. In accordance with embodiments of the present disclosure, an outer surface of the vertical tracks 704 is coincident with a plane that also is coincident with an outer surface of the horizontal track 120. Although depicted in FIG. 7 as having the vertical tracks 704 on both legs 108 on a side of the work surface 100, other configurations are possible. For example, a vertical track 704 can be associated with a single leg 108, all of the legs 108, or some other number of legs 108, of the work surface 100.

Figure 9:
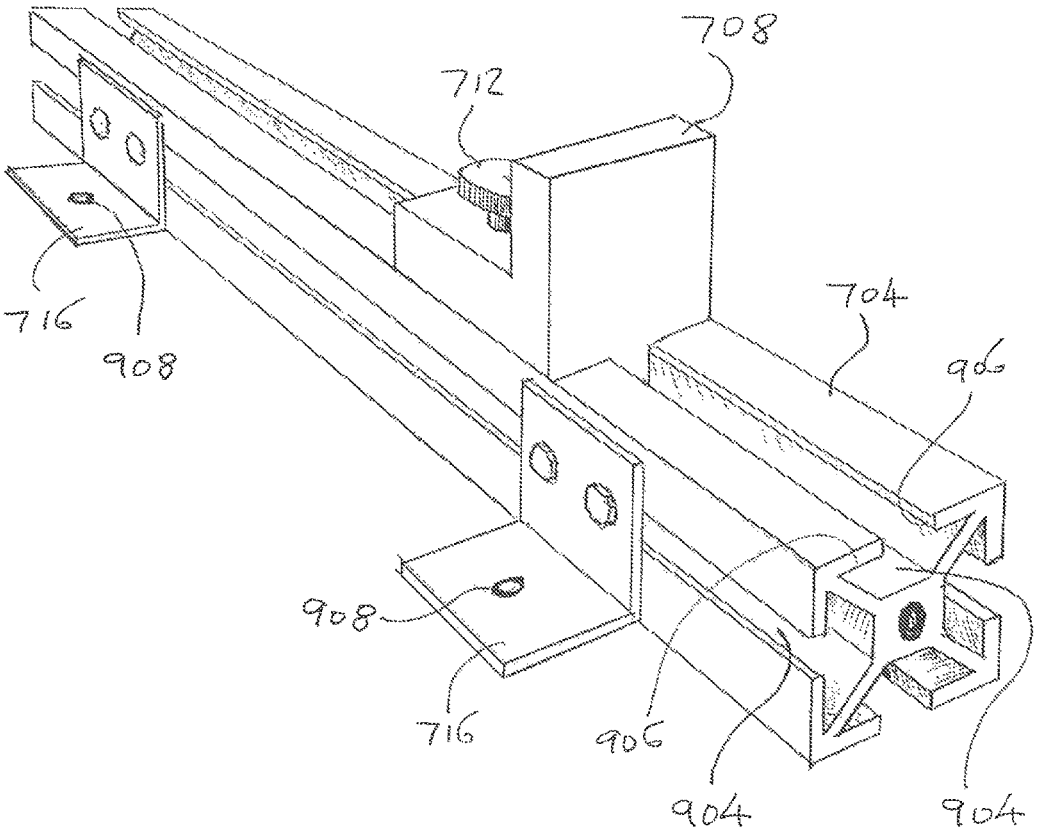
FIG. 9 is a perspective view of a vertical track and an installed support block in accordance with embodiments of the present disclosure.

With reference now to FIG. 9, a vertical track 704 is shown in a perspective view. In this example, the vertical track 704 has channels 904 and associated flanges 906 formed on each of four sides of the vertical track 704, when the vertical track 704 is viewed in cross-section. The mounting flanges 716 can include holes 908 for receiving the threaded fasteners 720, for instance as illustrated in FIG. 8. The mounting flanges 716 can be permanently or removably fixed to the vertical track 704, for example using fasteners received within one of the channels 904.

Figure 10:
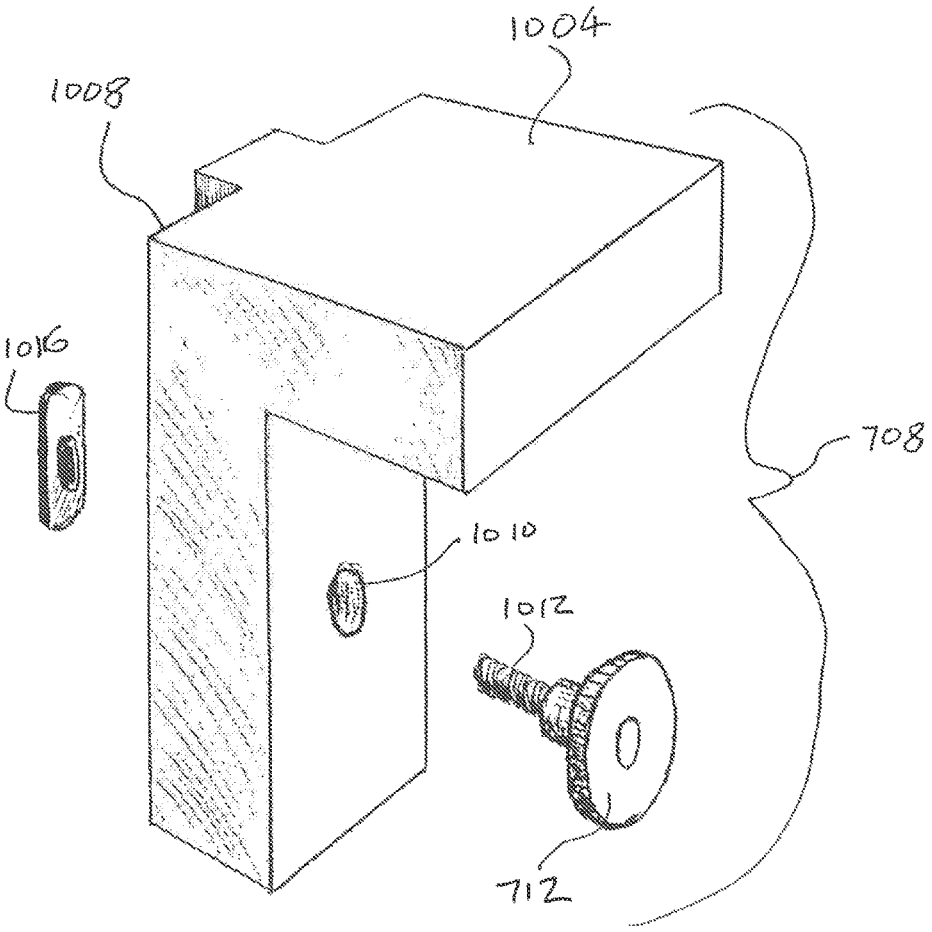
FIG. 10 is a front perspective view of a support block in accordance with embodiments of the present disclosure.

With reference now to FIG. 10, a support block 708 is shown in a top perspective view. In particular, the support block 708 includes a planar top or support surface 1004 that is perpendicular to a back surface 1008. Accordingly, when the support block 708 is received by a vertical track 704, the back surface 1008 is parallel to a longitudinal axis of the vertical track 704, while the support surface 1004 is perpendicular to the longitudinal axis of the vertical track 704. In addition, the fastening knob 712, receiving hole 1010, threaded fastener 1012 connected to the knob 712, and threaded plate 1016 that receives the threaded fastener 1012 to secure the support block 708 at a desired location along a vertical track 708 are shown.

Figure 11:
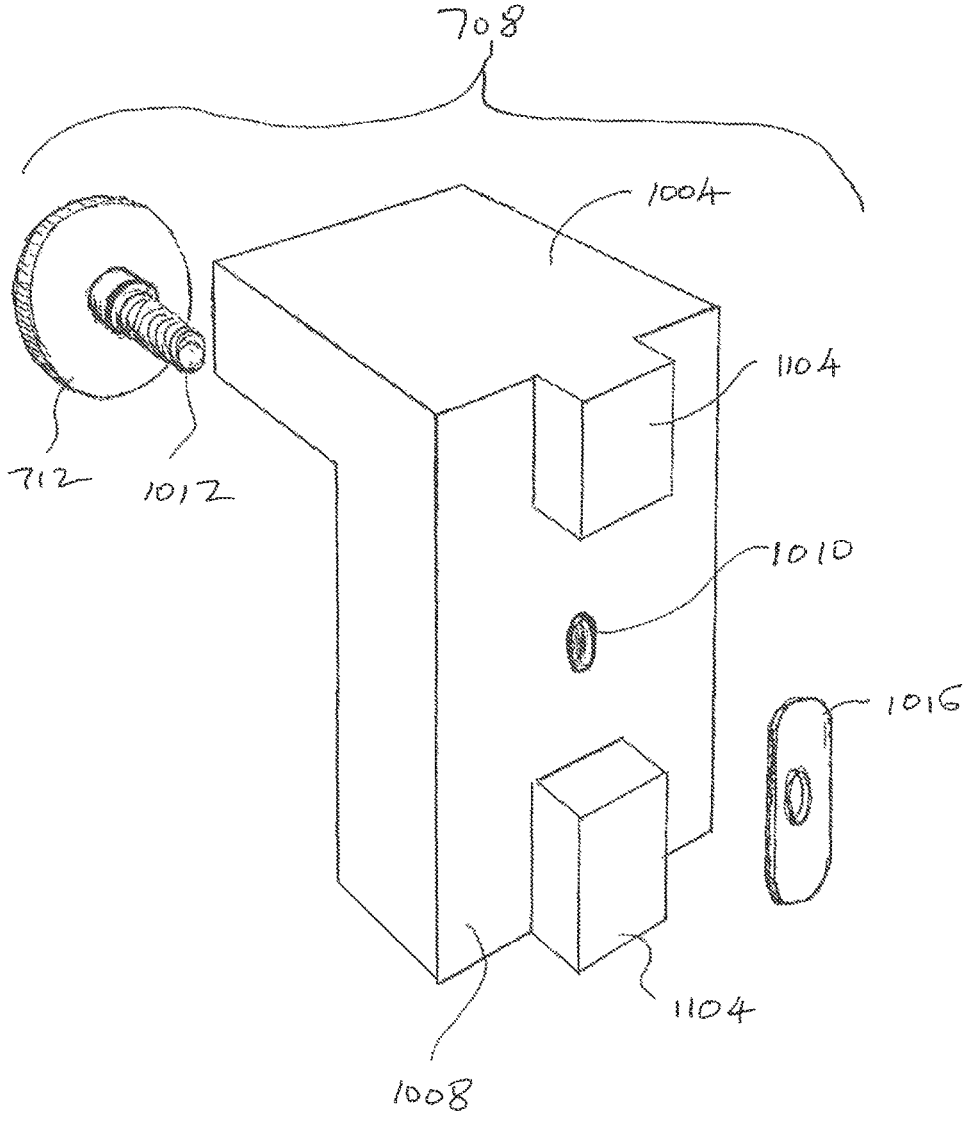
FIG. 11 is a rear perspective view of a support block in accordance with embodiments of the present disclosure.
Figure 12:
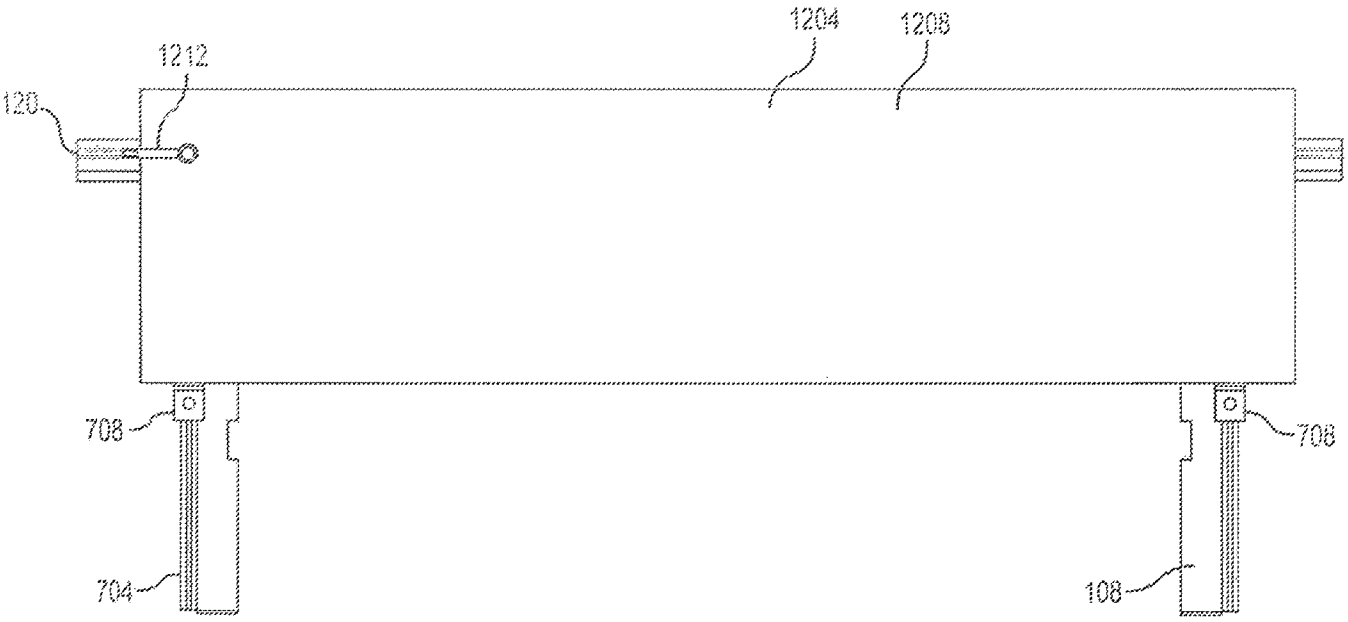
FIG. 12 is a side elevation view of the workbench of FIG. 1, with vertical tracks installed, and with a relatively large work piece held against a side of the workbench.
Figure 13:
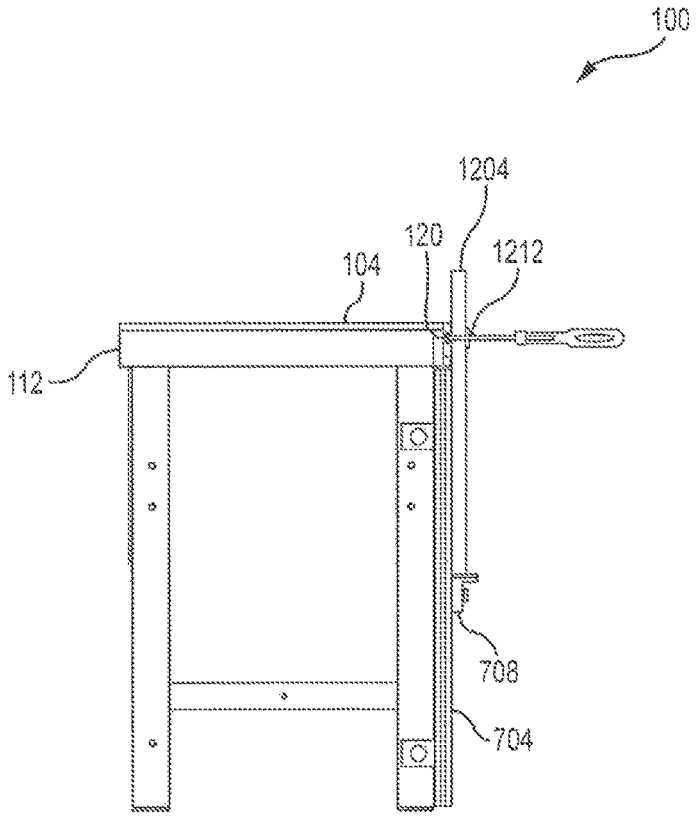
FIG. 13 is an end elevation view of the workbench of FIG. 1, with vertical tracks installed, and with a relatively large work piece held against a side of the workbench.

With reference now to FIG. 11, an exploded, rear perspective view of a support block 708 is shown. In this view, it can be seen that the threaded plate 1016 may have a width that is slightly larger than a gap between the flanges 906 of a channel 904 of the vertical track 704. Accordingly, when installed through an end of the vertical track 704, the support block 708 is captured within the receiving channel 904. As shown, the support block 708 can also include one or more locating members 1104. For example, as shown in FIG. 11, locating members 1104 can be provided on either side of the threaded plate 1104, to maintain an alignment of the support block 708 relative to the vertical track 704. In particular, the support surface 1004 of the support block 708 can be maintained in an orientation that is about (e.g., within ±3°) of being co-planar with the top surface 104 of the work surface 100. In accordance with at least some embodiments of the present disclosure, the locating members 1104 can have a t-shaped profile, to capture the support block 708 within the receiving channel 904.

Figure 14:
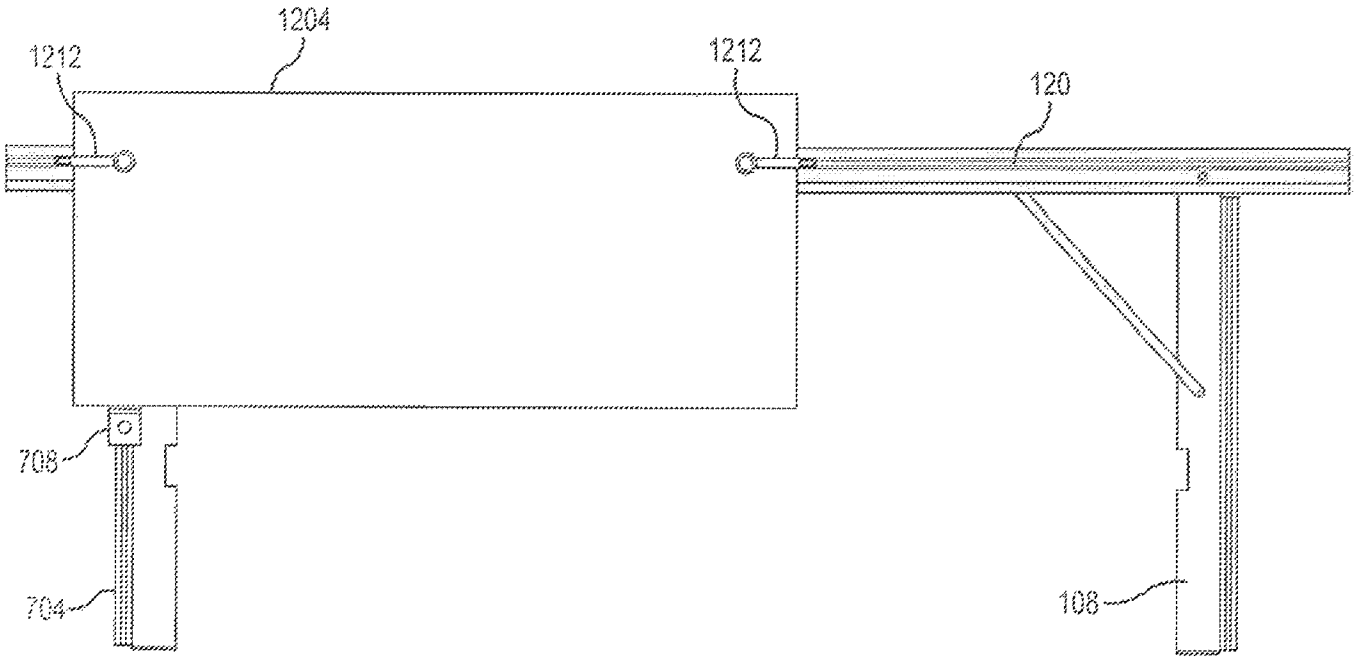
FIG. 14 is a side elevation view of the workbench of FIG. 1, with vertical tracks installed, and with a relatively small work piece held against a side of the workbench.
Figure 15:
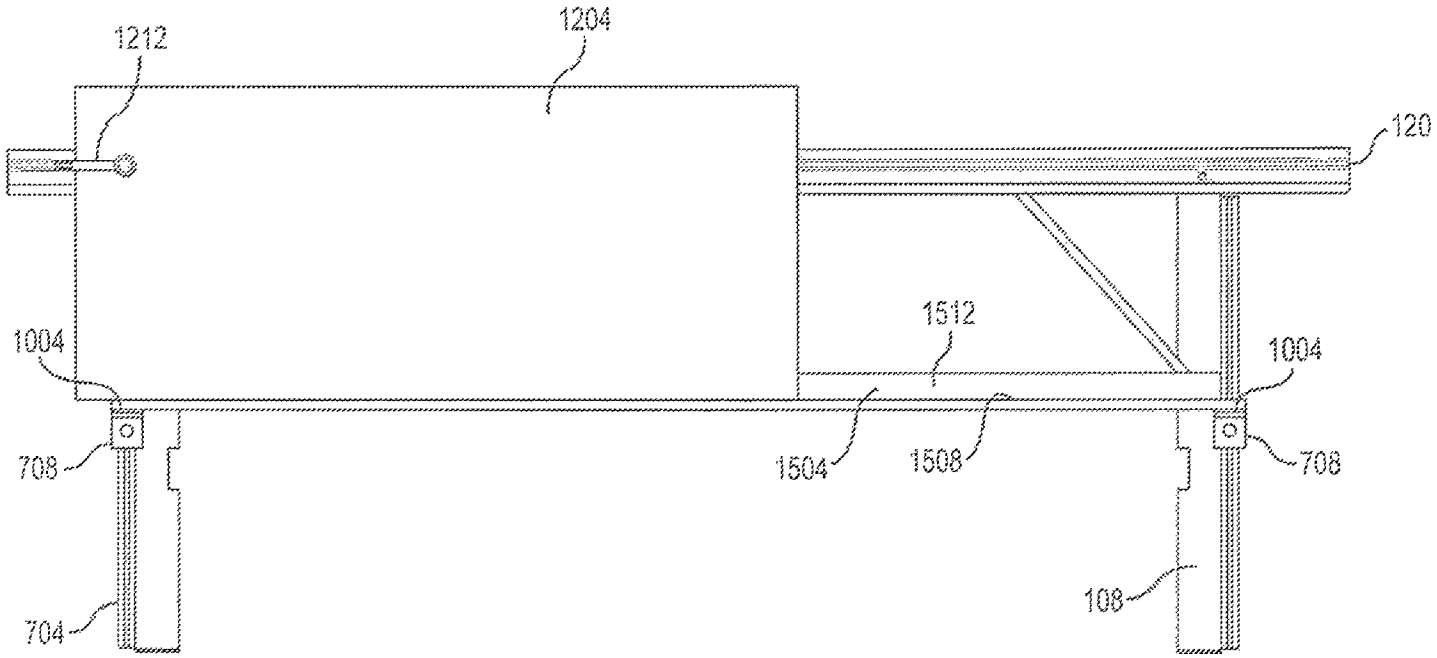
FIG. 15 is a side elevation view of the workbench of FIG. 1, with vertical tracks installed, and with a relatively small work piece held against a side of the workbench and using an alternate support block arrangement.

In addition to supporting workpieces, tools, or other objects on the top surface 104, the table 100 can be configured to hold workpieces during various machining operations. For example, as shown in FIGS. 12-15, components of the table 100 can be configured so as to provide a door/panel support. A door/panel support can be implemented by placing one or more support blocks 708 in vertical tracks 704 attached to one or more legs 108. A planar work piece 1204, such as a door or panel 1208, can then be supported along one edge by the one or more support blocks 708. In addition, the door or panel 1208 can be held against an edge of the top surface 104 by a clamp 1212 placed in the horizontal clamp track 120. Where the work piece 1204 is too short to extend between support blocks 708 on adjacent legs 108, for example as shown in FIG. 14, that work piece 1204 can be placed on one support block 708 at a first end, and can be held by friction against an edge of the top surface 104 by one or more clamps 1212 placed in the horizontal clamp track 120. As yet another alternative, as illustrated in FIG. 15, a pair of support blocks 708 can support or be connected to a support member 1504 that extends between opposed support blocks 708. The support member 1504 can include a first support surface 1508 that is co-planar with the support surfaces 1004 of the support blocks 708. In addition, the support member 1504 can include a back surface 1512 that is co-planar with an outer surface of the vertical tracks 704 and of the horizontal track 120. As shown, the work piece 1204 can further be secured by a clamp 1212 placed in the horizontal clamp track 120. Accordingly, even workpieces 1204 of relatively small size can be held against the side of the support surface 100.

Figure 16A:
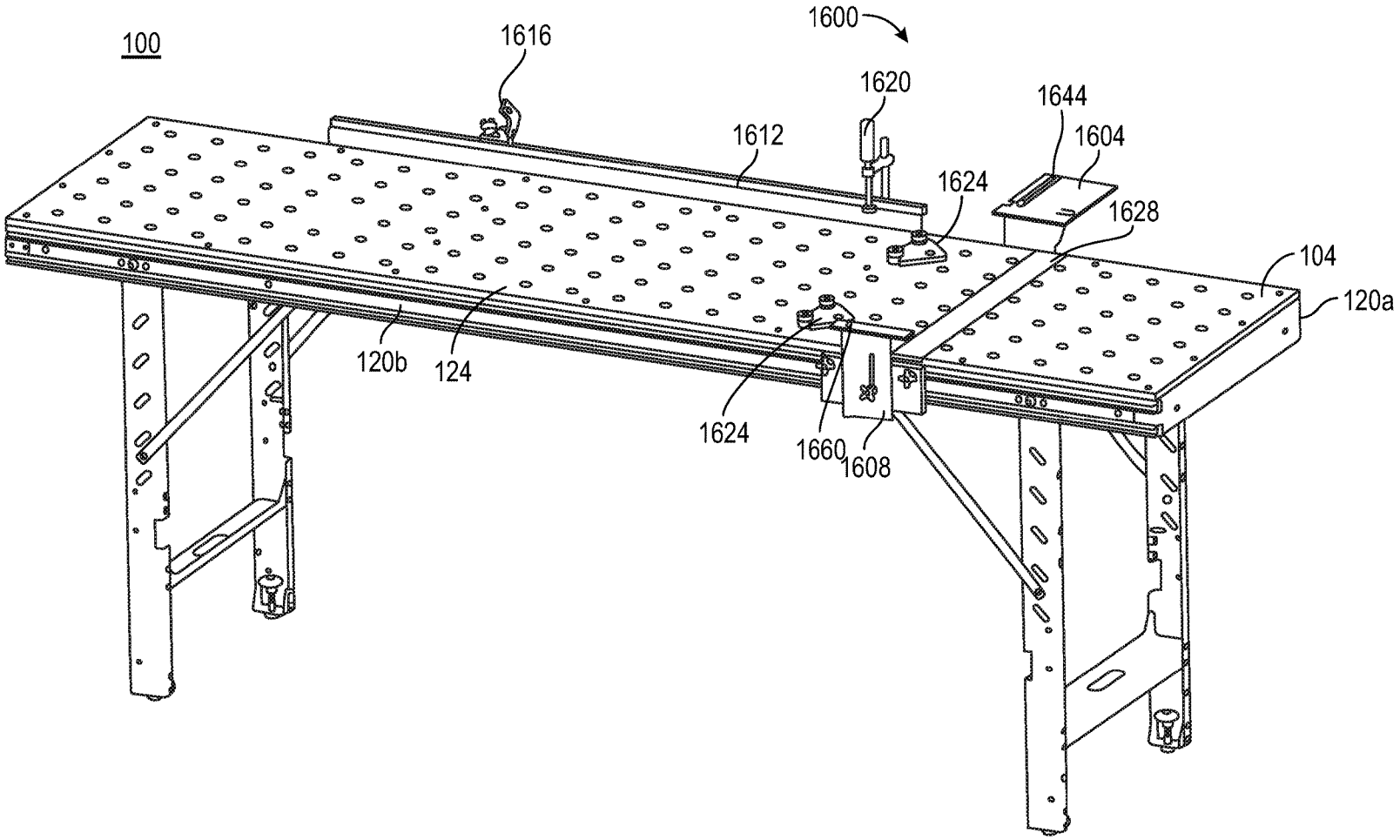
FIG. 16A is a top perspective view of a workbench with attached cross cut accessories in accordance with embodiments of the present disclosure.

With reference now to FIG. 16A, a work surface 100, with cross cut accessories 1600 installed, is depicted. The cross cut accessories 1600 can include a saw guide pivot plate assembly 1604, a saw guide support 1608, one or more fences 1612, a flip stop 1616, a workholding clamp 1620, and one or more set up arrows 1624. In addition, a work surface 100 can be provided with a cross cut groove or recess 1628, to provide clearance for the blade of a saw used during cross cut operations. The saw guide pivot assembly 1604 and the fences 1612 are attached to the horizontal track 120*a* located along the rear edge of the top surface 104. The lateral position of the saw guide pivot assembly 1604 and the fences 1612 can be adjusted by moving those components 1604 and 1612 along the horizontal track 120*a*, and the selected lateral position can then be fixed using friction knobs or clamps. The saw guide support 1608 is attached to the horizontal track 120*b* located along the front edge of the top surface 104. The lateral position of the saw guide support 1608 can be adjusted by moving the support 1608 along the horizontal track 120*b*, and fixed using a friction knob or clamp. The set up arrows 1624 can be used, for example in combination with a saw guide, to ensure that the saw guide pivot assembly 1604 and the saw guide support 1608 are properly aligned. In accordance with embodiments of the present disclosure, the set up arrows can include pegs that are received by the holes 124 in the top surface 104 of the table 100. The set up arrows 1624 can be removed during sawing operations.

Figure 16B:
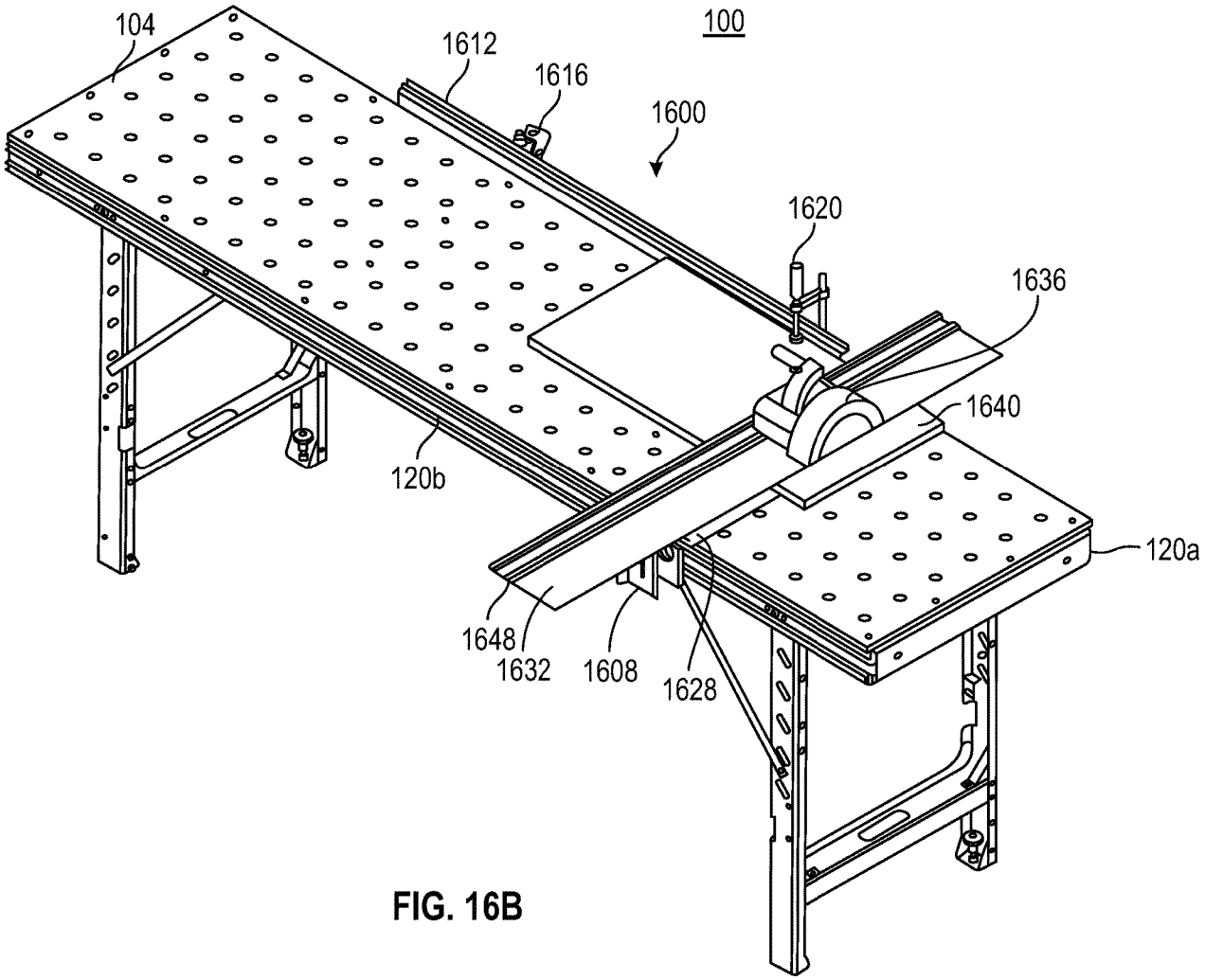
FIG. 16B is a top perspective view of the workbench with attached cross cut accessories of FIG. 16A, and with a saw guide, saw, and work piece.

In FIG. 16B, the work surface 100 and cross cut accessories 1600 are shown with a saw guide 1632 and a saw 1636 installed thereon, and with a work piece 1640 in position to be cut. The saw guide 1632 can include a groove 1648 having a pair of opposed, co-planar flanges 1652 with a space 1656 therebetween. The saw guide 1632 is attached at one end to the pivot plate assembly 1604 by a T-bar 1644 that is received in the groove 1648 of the saw guide 1632, behind the flanges 1652, such that the T-bar, when tightened, clamps a portion of the flanges 1652 between the T-bar 1644 and a surface of the pivot plate assembly 1604 (see FIGS. 16A, 16C, 17A-D, and 18A-B). The saw guide 1632 rests on the saw guide support 1608, with a locating pin 1660 of the saw guide support 1608 received in the space 1656 between the flanges 1652 of the groove 1648 to stabilize the saw guide 1632 laterally.

Figure 16C:
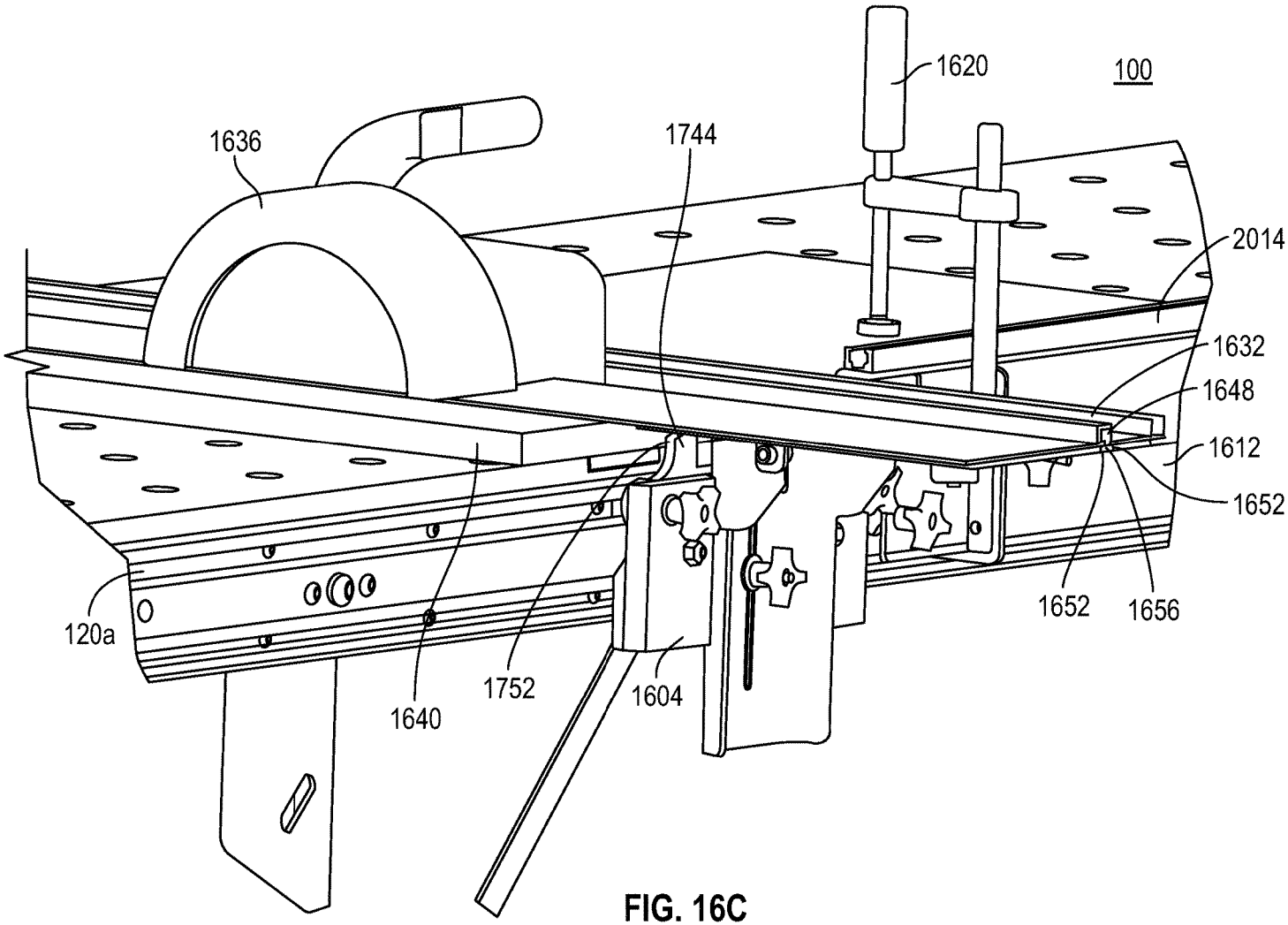
FIG. 16C illustrates a material support flag in a raised position.
Figure 17A:
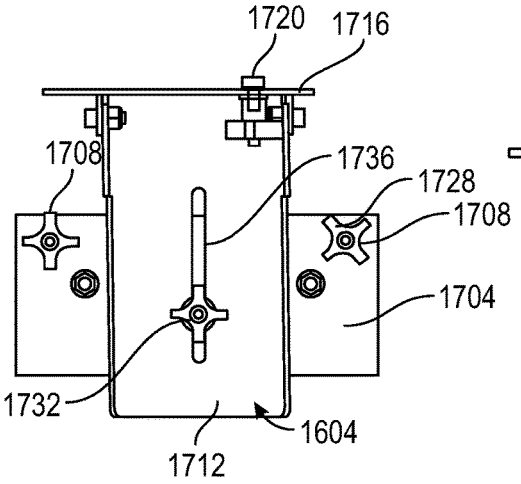
FIGS. 17A-D are views of a saw guide pivot assembly in accordance with embodiments of the present disclosure.
Figure 17B:
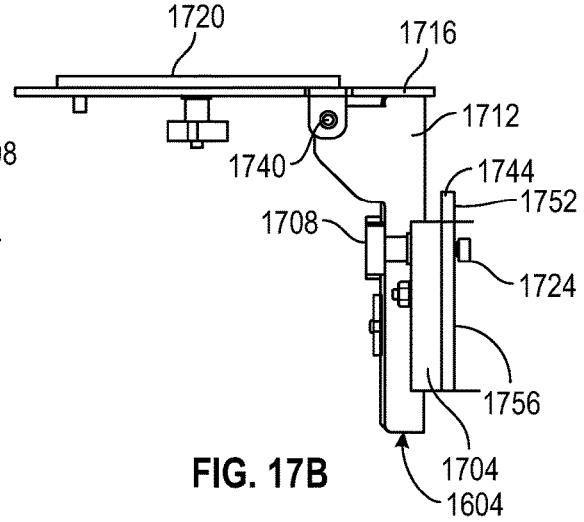
Figure 17C:
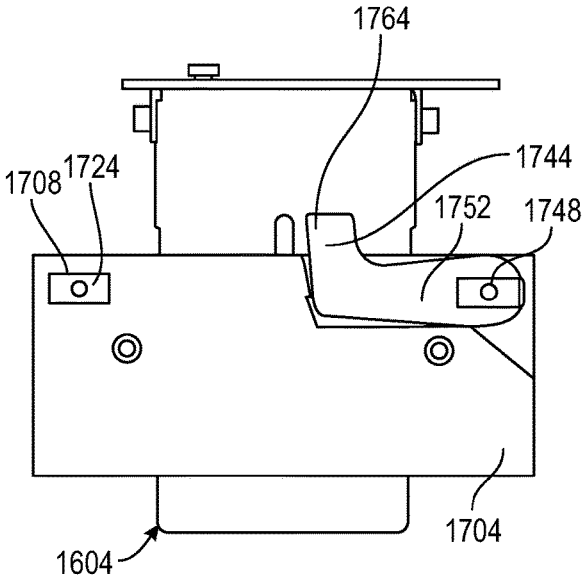
Figure 17D:
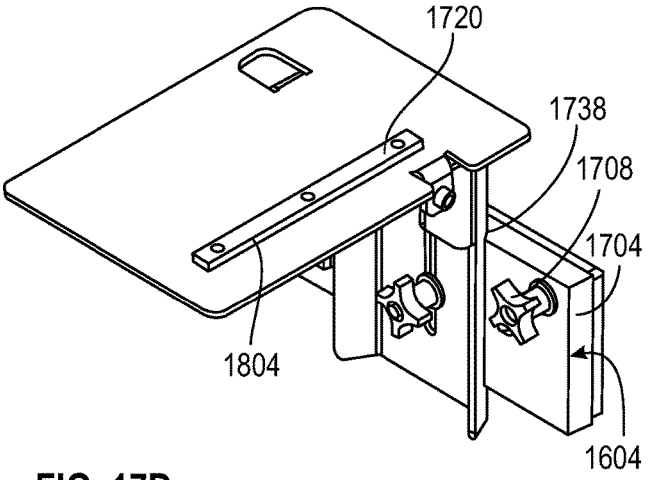

FIG. 16C is a partial view of a work surface 100, and shows a material support flag 1744 in a raised position. The material support flag 1744 has a support surface 1752 that is co-planar with a material support surface 2008 of the fence 1612, and provides additional support for the work piece 1640 during alignment and subsequent cutting operations.

With reference now to FIGS. 17A-D, the pivot plate assembly 1604 is shown in rear elevation, left side elevation, front elevation, and top perspective views respectively. The pivot plate assembly 1604 generally includes a base plate 1704, which includes mounts 1708 for attaching the pivot plate assembly 1604 to a track 120, a riser 1712, a pivot plate 1716, and an attachment assembly 1720. The mounts 1708 can include a threaded plate 1724 and a threaded fastener 1728. The threaded plate 1724 is received by the horizontal clamp track 120 when the pivot plate assembly 1604 is attached to the table 100. The location of the pivot plate assembly 1604 along the track 120 can be fixed by tightening the mount 1708, and the pivot plate location can be adjusted by loosening the mount 1708 and moving the pivot plate assembly 1604 to a desired position along the track 120. The height of the pivot plate 1716 can be adjusted by loosening a threaded fastener 1732 that extends through a vertical adjustment slot 1736 in the riser 1712, moving the riser 1712 within a channel 1738 formed in the base plate 1704 until the pivot plate 1716 is at a desired height, and tightening the threaded fastener 1732 to secure the riser 1712 and the pivot plate 1716 relative to the base plate 1704. The pivot plate 1716 includes a hinge 1740 that allows the pivot plate 1716 to pivot relative to the remainder of the pivot plate assembly 1604, which allows an attached saw guide 1632 to be lifted out of engagement with the saw guide support 1608 and away from the top surface 104 of the table 100, for example to facilitate placing a workpiece under the saw guide 1632.

In accordance with embodiments of the present disclosure, a material support flag 1744 is attached to the base plate 1704 by a pivot 1748 having an axis that is perpendicular to the plane that is coincident with the support surface 1752. The pivot 1748 can be formed by one of the pivot plate assembly 1604 mounts 1708. The material support flag 1744 can be placed in a raised position by rotating the material flag 1744 about the pivot 1748 in a clockwise direction in the view shown in FIG. 17C. When the material support flag 1744 is in the raised position, the material support flag 1744 provides a support surface 1752 that extends above a plane of the top surface 104 of the table 100, and that can help stabilize a work piece 1640 during alignment and cutting operations. The support surface 1752 is coplanar with a front surface of 1756 of the base plate 1704, which is in turn coplanar with an outer surface of the track 120 to which the pivot plate assembly 1604 is attached, and which is further coplanar with the material support surface 2008 of the fence 1612. The material support flag 1744 can also be placed in a stowed position, by folding the material support flag 1744 so that all of the material support surface 1752 is below the top surface 104 of the table 100. In addition, the height of the material support flag 1744 relative to the surface 104 of the table 100 can be varied by varying the rotation of the material support flag 1744 about the pivot 1748. For example, the material support flag 1744 can be pivoted until it is substantially vertical, such that it extends to a maximum height, or it can be pivoted such that it is at an angle between a folded, substantially horizontal angle, and the vertical angle, so that is at less than the maximum height. The material support flag 1744 can be formed with a tab 1764, to facilitate manual positioning of the material support flag 1744. More particularly, the tab 1764 can extend in a direction that is substantially perpendicular to a long axis of the material support flag 1744, such that the tab extends above a top of the base plate 1704 when the material support flag 1744 is in the stowed position (see FIG. 17C).

Figure 18A:
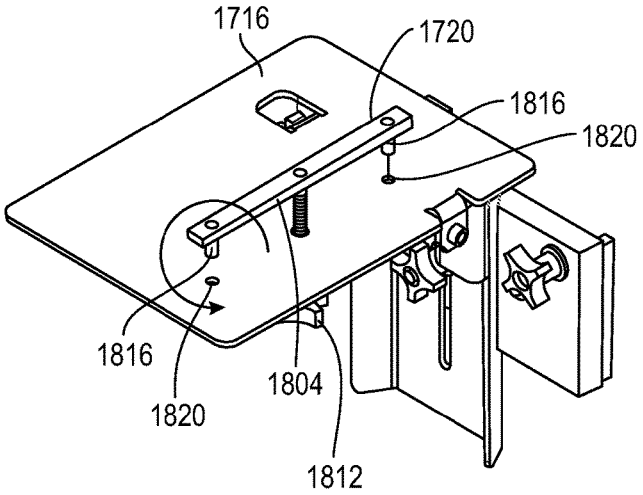
FIGS. 18A-B are exploded views of a pivot plate and a T-bar in accordance with embodiments of the present disclosure.
Figure 18C:
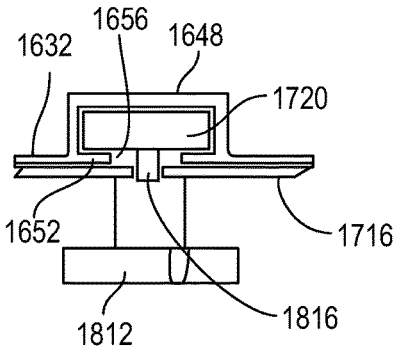
FIG. 18C is a detail view of an interface between an attachment assembly and a saw guide.
Figure 18B:
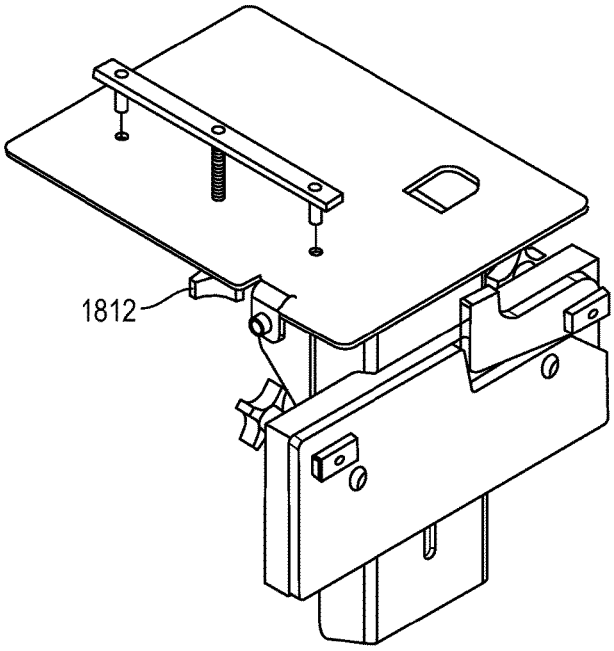
Figure 19A:
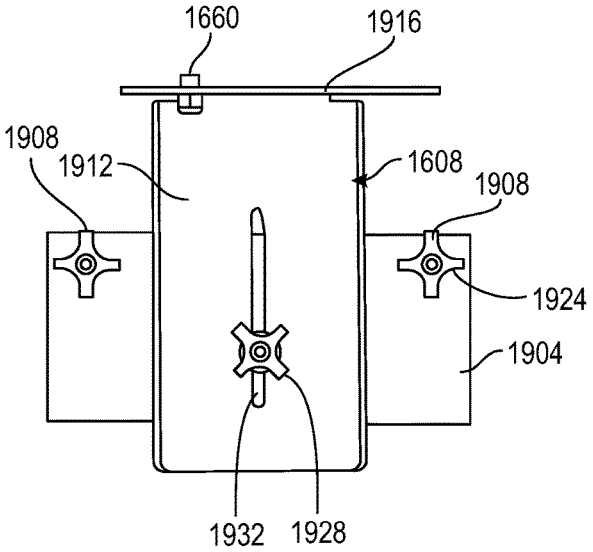
FIGS. 19A-D are views of a saw guide support in accordance with embodiments of the present disclosure.
Figure 19B:
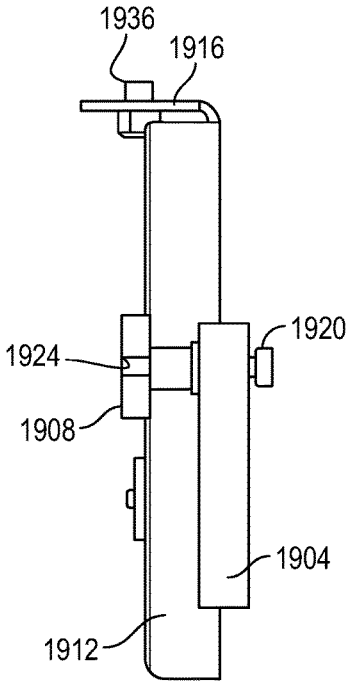
Figure 19C:
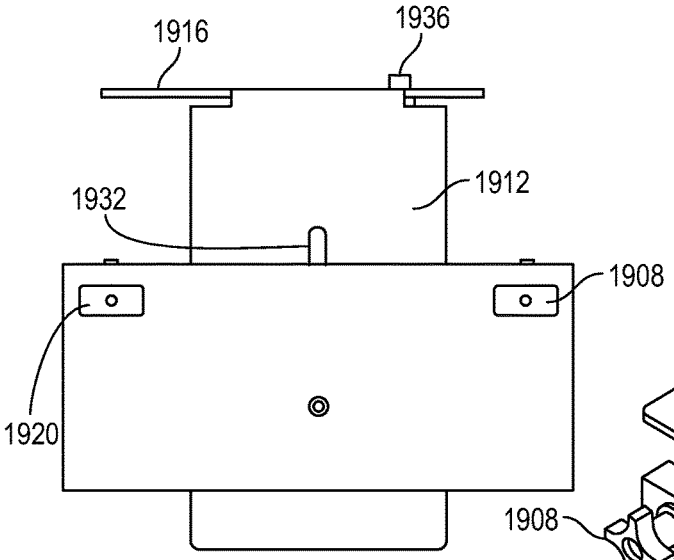
Figure 19D:
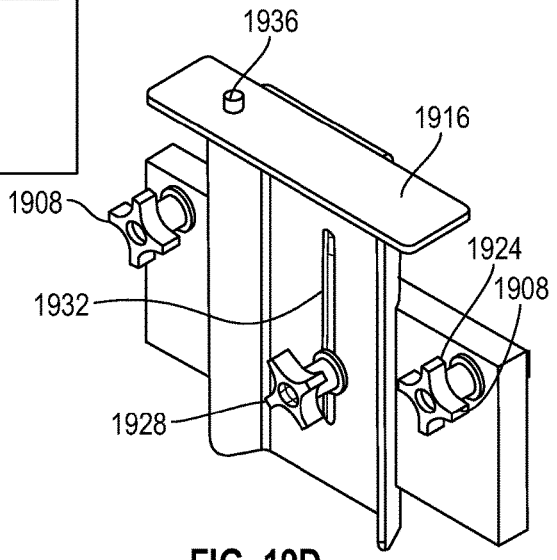
Figure 20C:
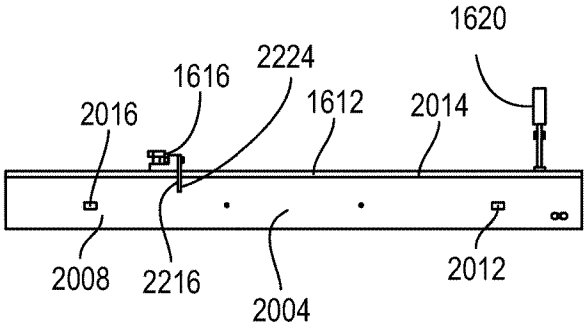
FIGS. 20A-D are views of a fence in accordance with embodiments of the present disclosure.
Figure 20B:
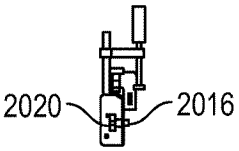
Figure 20A:
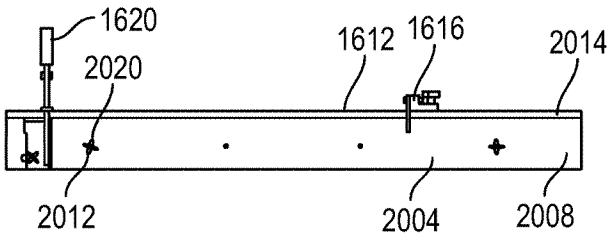
Figure 20D:
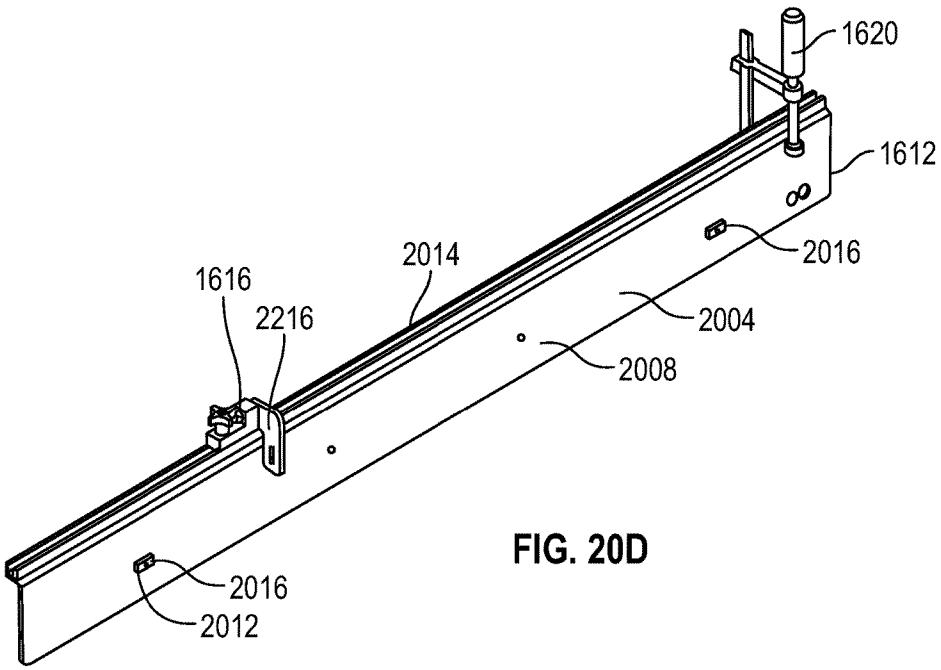

FIGS. 18A-B are front top perspective and rear top perspective views respectively of a pivot plate assembly 1604, showing details of the attachment assembly 1720 in accordance with embodiments of the present disclosure. In particular, the attachment assembly 1720 can include a T-bar 1804 that is dimensioned such that it can be received within a track of the saw guide 1632. A threaded fastener 1808 is provided to fix the attached saw guide 1632 to the pivot plate 1716 by tightening the fastener, thereby drawing the T-bar 1804 towards the pivot plate 1716, and clamping flanges of the saw guide 1632 between the T-bar 1804 and the pivot plate 1716 (see FIG. 18C). In addition, the T-bar 1804 can include two or more locating pins 1816 that are received by elongated holes 1820 formed in the pivot plate 1716. When received by the elongated holes, locating pins 1816 maintained the T-bar 1804 in an alignment that is substantially perpendicular to the track 120 to which the pivot plate assembly is attached. The elongated holes 1820 are elongated in the direction perpendicular to the track 120, to facilitate installation and removal of the T-bar 1804 relative to the pivot plate 1716, to provide a close tolerance with respect to the locating pins 1816 in a direction parallel to the track 120, and to maintain the desired alignment.

In FIGS. 19A-D, the saw guide support 1608 is shown in rear elevation, right side elevation, front elevation, and top perspective views respectively. The saw guide support 1608 generally includes a base plate 1904, which includes mounts 1908 for attaching the saw guide support 1608 to the track 120, a riser 1912, and a support surface 1916. The mounts 1908 can include a threaded plate 1920 and a threaded fastener 1924. The threaded plate 1920 is received by the horizontal clamp track 120. The location of the saw guide support 1608 along the track 120 can be fixed by tightening the mounts 1908, or adjusted by loosening the mount 1908 and moving the saw guide support 1608 to the desired position along the track 120. The height of the support surface 1916 can be adjusted by loosening a threaded fastener 1928 that extends through a vertical adjustment slot 1932 in the riser 1912, moving the riser 1912 until the support surface 1916 is at a desired height, and tightening the threaded fastener 1928. One or more locating pins 1936 extend from a surface of the support surface 1916, and are dimensioned to be received by the groove 1648 in the saw guide 1632 when the pivot plate assembly 1604 and the attached saw guide 1632 are placed in the down or cutting position.

FIGS. 20A-D are views of a fence 1612 in accordance with embodiments of the present disclosure. The fence 1612 generally includes a main member 2004 that provides a material support surface 2008 that lies in a plane corresponding to the plane of the track 120 surface when the fence 1612 is attached to the table 100. The main member 2004 includes mounts 2012 for attaching the fence 1612 to a track 120. The mounts 2012 can include a threaded plate 2016 and a threaded fastener 2020. The threaded plate 2016 is received by the horizontal clamp track 120, when the fence in 1612 is installed on the table 120. The location of the fence 1612 along the track 120 can be fixed by tightening the mounts 2012, or adjusted by loosening the mount 2012 and moving the fence 1612 to a desired position along the track 120. In addition, the main member 2004 can include a top track 2014 that extends along a top edge of the main member 2004, in a plane that is parallel to a plane of the top surface 104 of the table 100. A flip stop 1616 and a workpiece clamp 1620 can be connected to the fence 1612. The flip stop 1616 and workpiece clamp 1620 can be used to hold the work piece in position. More particularly, the flip stop 1616 can be mounted to the top track 2014 and provides a stop member 2216 with a surface 2224 that is perpendicular to the plane of the material support surface 2008. The flip stop 1616 can thus be used to quickly position the workpiece relative to the saw blade, for example where multiple parts are being cut to the same length, by moving the flip stop 1616 along the top track 2014 so that the stop member 2216 surface 2224 is a desired distance from the line through which the saw blade will travel during a cut, and placing the stop member into an operational position by pivoting the stop member 2216 so that it is in contact with the support surface 2208 of the fence 1612. Alternative, the stop member 2216 can be pivoted so that it is away from the support surface 2208, for example to allow a work piece to be slid down the entire length of the fence 1612. The workpiece clamp 1620 can be used to hold the work piece, against the top surface 104, while the workpiece is being cut.

Figure 21B:
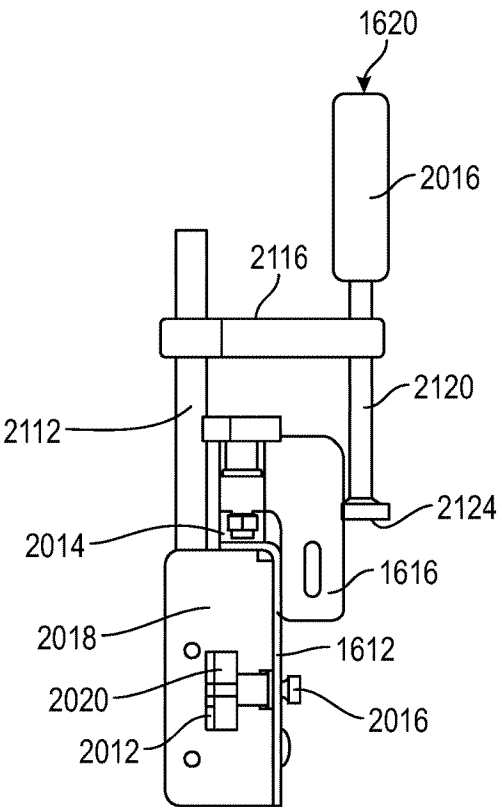
FIGS. 21A-B are views of a work holding clamp in accordance with embodiments of the present disclosure.
Figure 21A:
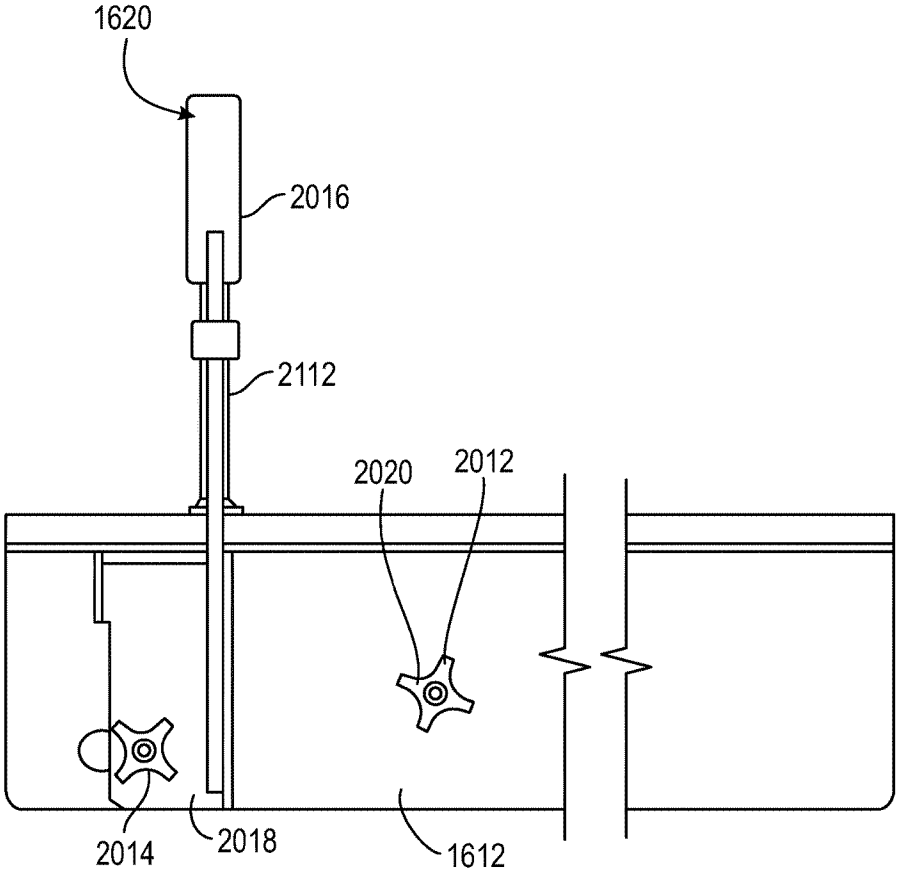

Details of a workpiece clamp 1620 are shown in FIGS. 21A-B. In this exemplary embodiment, the workpiece clamp 1620 is mounted to a fence 1612 by a threaded fastener 2104 that is mounted to and extends through a bracket 2108, to engage a threaded hole formed in the fence 1612. The workpiece clamp 1620 can include a riser 2112 extending from the bracket 2108, to a location above a top surface of the fence 1612 top track 2014. A clamp arm 2116 is connected to the riser 2112 at a first end, and extends over the top of the fence 1612, where a second end receives a threaded clamp member 2120. As can be appreciated by one of skill in the art after consideration of the present disclosure, by turning the threaded clamp member 2120 in a direction that brings the end of the clamp member towards the top surface number 104 of the table 100, a workpiece can be clamped between the end 2124 of the clamp member 2120 and the top surface 104. In accordance with the least some embodiments of the present disclosure, the clamp arm 2116 position along the riser 2112 can be adjusted, to facilitate accommodating difference workpiece thicknesses.

Figure 22A:
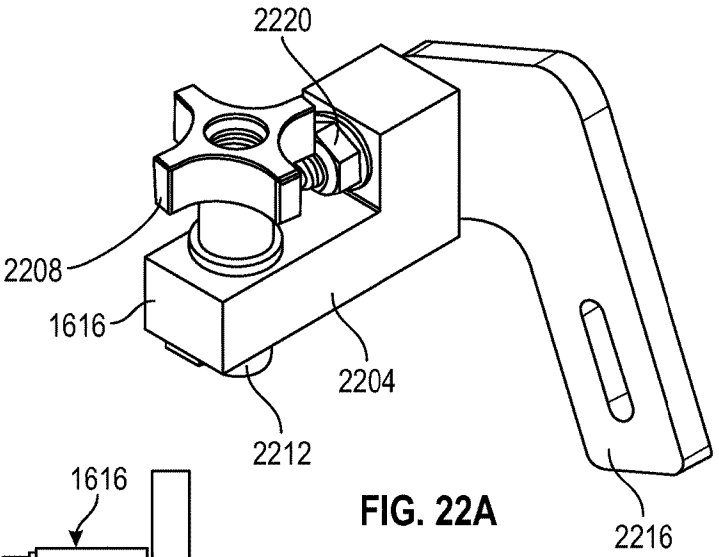
FIGS. 22A-C are views of a flip stop in accordance with embodiments of the present disclosure.
Figure 22B:
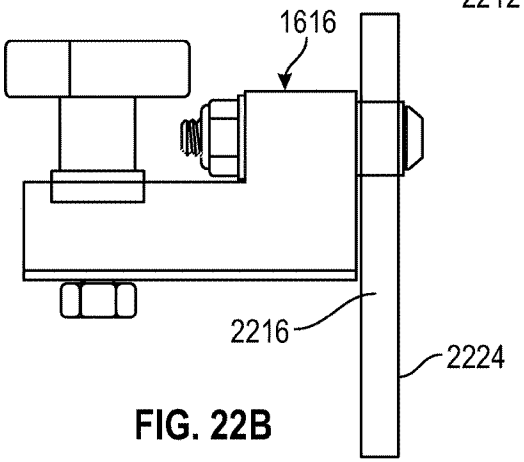
Figure 22C:
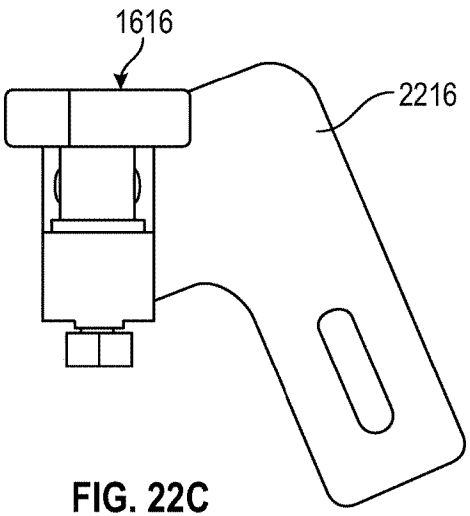

Features of a flip stop 1616 are illustrated in FIGS. 22A-C. The flip stop 1616 generally includes a bracket 2204 with a fastener 2208 having a threaded nut or plate 2212 that is configured to be received within a channel of the fence 1612 top track 2014. A stop member 2216 is connected to the bracket 2204 by a pivot 2220. Accordingly, the stop member 2216 can be pivoted into position, where it is operable to maintain a workpiece in a position proximate to the saw blade (see, e.g., FIG. 20D), or flipped out of position (see, e.g., FIG. 16A), to allow the workpiece to be slid away from the saw blade.

Figure 23:
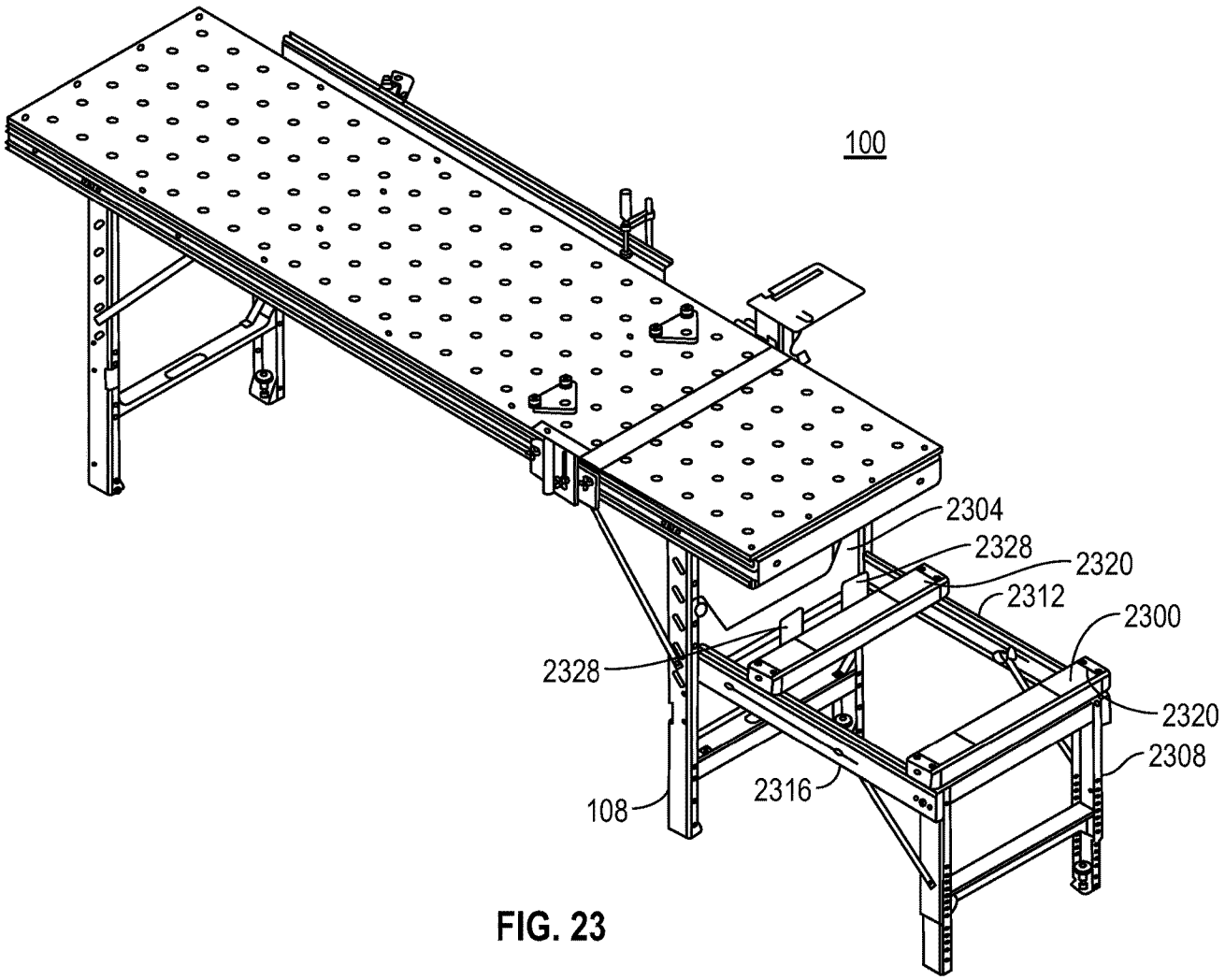
FIG. 23 is a top perspective view of a workbench with an attached saw stand in accordance with embodiments of the present disclosure.

With reference now to FIG. 23, a work surface 100 with an attached accessory or saw stand 2300 in accordance with embodiments of the present disclosure is depicted. The saw stand 2300 generally provides an adjustable, stable stand or mount for a portable saw or other tool. For example, the saw stand 2300 can be used to hold a portable table saw securely and at a height such that the top surface of the table saw lies in the same plane as the top surface 104 of the table 100. At a first end, the saw stand 2300 is attached to the legs 108 of the table 100 by a mounting bracket 2304, while a second end is supported by a pair of saw stand legs 2308. The location along the legs 108 at which the saw stand 2300 is attached to the table 100, and the length of the legs 2308, can be adjusted to place a saw or other tool supported by the saw stand 2300 at a desired height relative to the top surface 104 of the table 100.

As also shown in FIGS. 24A-C, tracks 2312 can be provided along top surfaces of saw stand rails 2316 that extend between the mounting bracket 2304 and the legs 2308. First and second saw rests 2320 can be mounted to the rails 2316. The location of the saw rests 2320 along the rails can be selected to correspond to the positions of support legs, the base, or other support features of a tool. The height of the saw rests 2320 can be adjusted selectively to raise or lower the tool, to enable the tool supported by the saw stand 2300 to be positioned correctly relative to the table 100 in a vertical direction. At least one of the saw rests 2320 can include curbs 2328 that can be adjusted relative to the first saw rest 2320 to conform to the size and shape of the tool, to provide a stop that facilitates placing a particular tool on the saw stand 2300 in the correct position relative to the table 100.

In accordance with at least some embodiments of the present disclosure, and with particular reference now to FIG. 24C, each saw rest 2320 can be provided as an assembly that includes a bottom C-channel member 2332, oriented such that the legs of the "C" point upward, and a top C-channel member 2336, oriented such that legs of the "C" point down. In addition, the legs of the bottom C-channel member 2332 can be received within the legs of the top C-channel member 2336. The bottom C-channel member 2332 includes a fastener 2338 at each end that is received by a track 2312 on a top surface of a respective saw stand rail 2316, and can be moved along the length of the track 2312 to a desired location. The top C-channel member 2336 provides a support surface 2340 for a supported tool. The top C-Channel member 2336 can be supported by threaded adjustment members 2344, that allow a distance between the support surface 2340 and the bottom C-channel member 2332 to be adjusted, for example to enable precise alignment of a surface of a supported tool relative to the top surface 104 of the table 100.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A method of supporting and aligning a work piece, comprising:

providing a portable work surface, the portable work surface including:

a planar top surface;

a plurality of legs, wherein the legs fold flat against a back of the planar top surface when the portable work surface is in a folded configuration, and wherein the legs are substantially orthogonal to the planar top surface when the portable work surface is in a deployed configuration;

connecting a pivot plate assembly to a first horizontal track that extends along a first edge of the top surface;

positioning a material support flag provided as part of the pivot plate assembly such that a support surface of the material support flag extends to a point above the planar top surface of the portable work surface;

connecting a saw guide support to a second horizontal track that extends along a second edge of the top surface;

connecting a first end of a saw guide to the pivot plate assembly, wherein connecting the first end of the saw guide to the pivot plate assembly includes receiving a T-bar connected to a pivot plate of the pivot plate assembly in a groove of the saw guide; and resting a second end of the saw guide on the saw guide support.

2. The method of claim 1, further comprising:

connecting a fence to the first horizontal track, wherein the fence includes a material support surface that is coplanar with the support surface of the material support flag;

placing a work piece between the saw guide and the top surface of the portable work surface, wherein an edge of the work piece is coplanar with the support surface of the fence and with the support surface of the material support flag.

* * * * *